US009831623B2

(12) United States Patent
Utermoehle et al.

(10) Patent No.: US 9,831,623 B2
(45) Date of Patent: Nov. 28, 2017

(54) CONNECTION ADAPTER FOR TRANSMITTING SIGNALS OF A PROGRAMMABLE LOGIC CONTROLLER

(71) Applicant: Phoenix Contact GmbH & Co. KG, Blomberg (DE)

(72) Inventors: Daniel Utermoehle, Uslar (DE); Peter Wille, Paderborn (DE); Werner Schaefertoens, Lemgo (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/124,677

(22) PCT Filed: Mar. 11, 2015

(86) PCT No.: PCT/EP2015/055012

§ 371 (c)(1),
(2) Date: Sep. 9, 2016

(87) PCT Pub. No.: WO2015/135964

PCT Pub. Date: Sep. 17, 2015

(65) Prior Publication Data

US 2017/0018899 A1 Jan. 19, 2017

(30) Foreign Application Priority Data

Mar. 13, 2014 (DE) ..... 10 2014 103 380

(51) Int. Cl.
*H01R 31/00* (2006.01)
*H01R 4/18* (2006.01)
(Continued)

(52) U.S. Cl.
CPC ..... *H01R 31/005* (2013.01); *H01R 4/183* (2013.01); *H01R 13/432* (2013.01);
(Continued)

(58) Field of Classification Search
CPC ..... H01R 31/005; H01R 4/183; H01R 13/432
(Continued)

(56) References Cited

U.S. PATENT DOCUMENTS 4,889,500 A * 12/1989 Lazar ..... H01R 23/688 439/364
5,466,175 A * 11/1995 Onoda ..... H01R 9/0518 439/607.48

(Continued)

FOREIGN PATENT DOCUMENTS

EP 0630081 A1 12/1994
EP 0952637 A1 10/1999
JP H09213422 A 8/1997

*Primary Examiner* — Alexander Gilman
(74) *Attorney, Agent, or Firm* — Leydig, Voit & Mayer, Ltd.

(57) ABSTRACT

A connection adapter for transmitting signals of a programmable logic controller having a signal interface with electrical contact pins arranged in rows includes contact terminals for electrically contacting the electrical contact pins of the signal interface, each contact terminal being receiving one electrical contact pin of the signal interface; contact chambers for accommodating the contact terminals, each contact terminal being arranged in one contact chamber, the contact chambers being arranged in rows, with insulating elements being arranged between adjacent contact chambers; and a housing in which the contact terminals and the contact chambers are received, the housing being closed and electrically insulated.

14 Claims, 19 Drawing Sheets

(51) Int. Cl.
*H01R 13/432* (2006.01)
*H01R 13/58* (2006.01)
*H01R 13/621* (2006.01)
*H01R 13/66* (2006.01)

(52) U.S. Cl.
CPC ..... *H01R 13/5812* (2013.01); *H01R 13/621* (2013.01); *H01R 13/665* (2013.01)

(58) Field of Classification Search
USPC ..... 439/660
See application file for complete search history.

(56) References Cited

U.S. PATENT DOCUMENTS 5,480,327 A * 1/1996 Zola ..... H01R 9/0518 439/445
5,697,806 A * 12/1997 Whiteman, Jr. ..... H01R 31/00 439/353
5,971,791 A * 10/1999 Itoh ..... H01R 13/5202 439/364
5,997,348 A * 12/1999 Shepherd ..... H01R 9/032 439/579
6,171,143 B1 * 1/2001 Charles ..... H01R 13/65802 439/579
6,768,647 B1 * 7/2004 Kowtun ..... H01R 12/718 361/752
6,811,438 B1 * 11/2004 Ko ..... H01R 9/032 439/607.41
7,011,545 B2 * 3/2006 Brandt ..... H01R 9/05 439/579
8,325,759 B2 * 12/2012 Hazani ..... H04L 5/06 340/12.32
2013/0260619 A1 * 10/2013 Wallner ..... H01R 9/2425 439/709

* cited by examiner

CONNECTION ADAPTER FOR TRANSMITTING SIGNALS OF A PROGRAMMABLE LOGIC CONTROLLER

CROSS-REFERENCE TO PRIOR APPLICATIONS

This application is a U.S. National Phase application under 35 U.S.C. §371 of International Application No. PCT/EP2015/055012, filed on Mar. 11, 2015, and claims benefit to German Patent Application No. DE 10 2014 103 380.9, filed on Mar. 13, 2014. The International Application was published in German on Sep. 17, 2015 as WO 2015/135964 A1 under PCT Article 21(2).

FIELD

The present invention relates to a connection adapter for transmitting signals of a programmable logic controller.

BACKGROUND

A programmable logic controller can be used for automating and controlling industrial installations. To this end, the programmable logic controller comprises a signal interface for inputting and outputting signals. The signals can comprise analogue or digital signals for controlling a field device, for example an actuator or a sensor. Depending on the field device to be controlled, the signals used for control can have different voltages and current values. In particular when controlling relays, for example by means of a relay output board, voltages of up to 250V and current values of up to 8 A can be achieved.

The programmable logic controller is often connected to the field device via a series terminal. To electrically connect the programmable logic controller to the series terminal a so-called front adapter can be used. The front adapter can be pluggable into the signal interface of the programmable logic controller and can comprise electrical connecting lines for the electrical connection of the signal interface of the programmable logic controller to electrical connectors of the series terminal. In the process, the front adapter can be adapted geometrically to the signal interface of the programmable logic controller. Such front adapters are often only suitable for comparatively low voltages of up to 24V due to electric-shock protection.

SUMMARY

A connection adapter for transmitting signals of a programmable logic controller, the programmable logic controller including a signal interface with electrical contact pins arranged in rows, the connection adapter including contact terminals for electrically contacting the electrical contact pins of the signal interface, each contact terminal being receiving a respective one of the electrical contact pins; contact chambers for accommodating the contact terminals, each contact terminal being arranged in a respective one of the contact chambers, the contact chambers being arranged in rows, with insulating elements being arranged between adjacent contact chambers; and a housing in which the contact terminals and the contact chambers are received, the housing being closed and electrically insulated.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
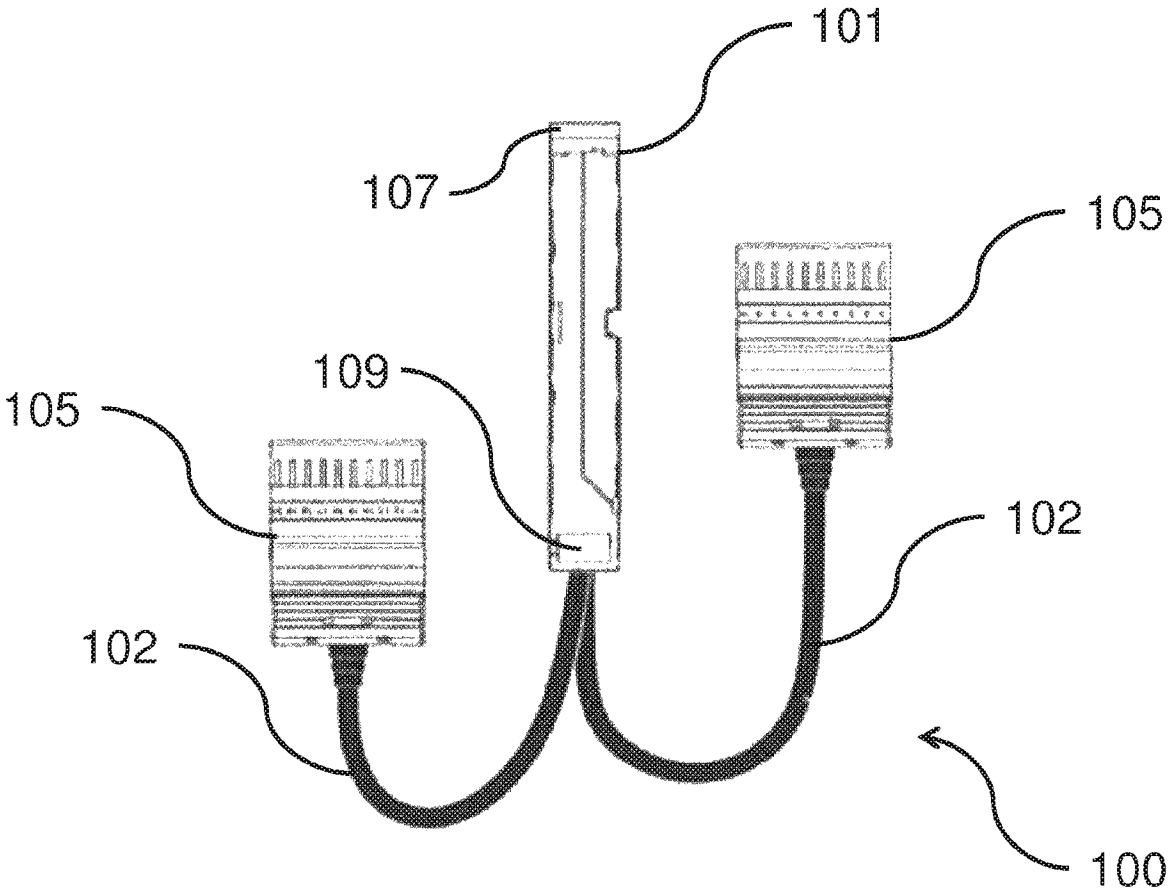
FIG. 1 is a schematic view of a connection adapter according to an embodiment.

In an embodiment, the invention provides a connection adapter for transmitting signals of a programmable logic controller, the programmable logic controller comprising a signal interface with electrical contact pins arranged in rows with: contact terminals for the electrical contacting of the electrical contact pins of the signal interface, each contact terminal being configured for respectively receiving an electrical contact pin of the signal interface; contact chambers for receiving the contact terminals, each contact terminal being arranged in one contact chamber and the contact chambers being arranged in rows, and insulating elements being arranged between adjacent contact chambers to increase a dielectric strength; and a housing in which the contact terminals and the contact chambers are received, the housing being closed and electrically insulated. The technical advantage that a connection adapter with an electric-shock-proof housing can be provided is thus achieved.

The signals can be analogue or digital signals for controlling a field device. The field device can be an actuator or a sensor. Furthermore, the programmable logic controller can be a programmable device for controlling the field device.

The signal interface can be designed to input and output the signals for controlling the field device. To this end, the signal interface comprises electrical contact pins arranged in rows. For example, the signal interface comprises ten contact pins arranged in rows for controlling the field device. In the process, two contact pins can be used to supply power to the field device. The remaining eight contact pins can be used for the input and output of the signals for controlling the field device. Furthermore, the signal interface can be designed to control a plurality of field devices. For example, the signal interface comprises two, three, four, five, ten, fifteen or twenty rows of contact pins, each row of contact pins being provided for controlling one field device.

The electrical contact pins can be connector pins. Furthermore, the number of contact terminals can be less than or equal to the number of contact chambers.

The insulating elements can be formed by elements of the housing. For example, the insulating elements are formed by webs of the housing, which separate adjacent contact chambers in an electrically insulating manner.

The housing can be constructed so as to be electric-shock-proof for a user. For example, the housing is electric-shock-proof against access with a finger according to the IP20 standard. Furthermore, the housing can comprise glass-fiber-reinforced plastics material.

In an advantageous embodiment of the connection adapter, the connection adapter comprises electrical connection lines, which are electrically connected to the contact terminals, each electrical connection line being electrically connected to one contact terminal, and the housing having a housing opening for passing the electrical connection lines out of the housing. The technical advantage that the signals of the programmable logic controller can be conducted out of the housing of the connection adapter is thus achieved.

The electrical connection lines can have a cross-sectional area or a cross section of 0.14 $mm^2$ to 0.5 $mm^2$ in the case of full loading. In addition, up to 1.5 $mm^2$ is possible if partially loaded. Furthermore, each electrical connection line can be electrically connected to one contact terminal by means of a screw connection, a crimped connection or a spring-loaded terminal. The quantity of the electrical connection lines can be less than or equal to the number of contact terminals.

In a further advantageous embodiment of the connection adapter, the connection adapter further comprises a first quantity of series terminal connectors, the series terminal connectors being arranged outside of the housing, and each series terminal connector being electrically connected to a second quantity of the electrical connection lines. The technical advantage that an electric-shock-proof and voltage-stable connection adapter for electrically connecting the programmable logic controller to the field device via a series terminal can be provided is thus achieved.

The series terminal connector can be a series terminal plug. Furthermore, the first quantity can correspond to the quantity of field devices to be controlled. For example, the first quantity is 1, 2, 3, 4, 5, 6, 7, 8, 9 or 10. The second quantity can be the quantity of the signal lines which are required to control a field device. For example, the second quantity is 1, 2, 3, 4, 5, 6, 7, 8, 9, 10, 12, 14, 16, 18, 20, 25, 30, 35 or 40.

In a further advantageous embodiment of the connection adapter, the connection adapter further comprises a flat closing element for closing the housing opening for passing the electrical connection lines out of the housing. The technical advantage that the housing opening for electrical connection lines can be used with different cross-sectional areas is thus achieved.

The geometric shape of the flat element can be adapted to the shape of the housing opening and to the cross-sectional area of a line bundle of the electrical connection lines. Furthermore, the flat closing element can be formed by a lamella.

In a further advantageous embodiment of the connection adapter, the housing further comprises a fastening device for fastening a tension relief device. The technical advantage that a tension relief device of the electrical connection lines can be provided is thus achieved.

The fastening device can be formed by a web of the housing. Furthermore, the tension relief device can be formed by a cable tie.

In a further advantageous embodiment of the connection adapter, the housing further comprises a further fastening device for fastening a tension relief device, and the fastening device and the further fastening device are separated by a separating device. The technical advantage that the electrical connection lines can be connected efficiently to the housing for tension relief is thus achieved.

The further fastening device can be formed by a web of the housing. Furthermore, the separating device can be formed by a web of the housing.

In a further advantageous embodiment of the connection adapter, the housing can be locked to the signal interface, in particular can be locked by means of a locking element. The technical advantage that the housing can be fastened efficiently to the signal interface is thus achieved.

The housing can comprise a locking device with a locking latch and a latch spring and/or a latching element. Furthermore, the signal interface can comprise a latch opening.

In a further advantageous embodiment of the connection adapter, the housing can be connected to the signal interface in a force-locked manner, in particular by means of a screw connection. The technical advantage that the housing can be fastened to the signal interface so as to be protected in transit is thus achieved.

The housing can comprise a transit screw or a fixing screw for producing the screw connection. Furthermore, the housing can comprise a locking washer for securing the transit screw or the fixing screw. The signal interface can comprise a screw thread into which the transit screw or the fixing screw can be introduced.

In a further advantageous embodiment of the connection adapter, each contact terminal comprises a spring-loaded terminal for receiving an electrical contact pin of the signal interface. The technical advantage that efficient and detachable electrical contact between the electrical contact pins of the signal interface and the contact terminals can be established is thus achieved.

In a further advantageous embodiment of the connection adapter, each contact terminal further comprises a crimp contact for electrically connecting to an electrical connection line. The technical advantage that efficient electrical contact can be established between the contact terminals and the electrical connection lines is thus achieved.

In a further advantageous embodiment of the connection adapter, each contact terminal can be snap-fitted to a contact chamber. The technical advantage that the contact terminals can be fixed mechanically in the contact chambers is thus achieved.

The contact terminals can comprise a snap-fit element or a catch spring for producing the snap fit. Furthermore, the contact chamber can comprise a snap-on catch for producing the snap fit.

In a further advantageous embodiment of the connection adapter, the insulating elements comprise webs for increasing an electrical creepage path. The technical advantage that the connection adapter can be used for transmitting signals with high voltages is thus achieved.

In a further advantageous embodiment of the connection adapter, the insulating elements further comprise protruding portions for increasing the electrical creepage path. The technical advantage that the dielectric strength of the connection adapter can be increased is thus achieved.

In a further advantageous embodiment of the connection adapter, the housing comprises a lower housing part, in which the contact terminals and the contact chambers are received, and a housing cover. The technical advantage that the connection adapter can be produced particularly simply is thus achieved.

The housing cover can be detachable from the housing cover.

In a further advantageous embodiment of the connection adapter, the housing cover is lockable to the lower housing part. The technical advantage that the housing cover can be fastened efficiently to the lower housing part is thus achieved.

The housing cover can comprise a latching hook. Furthermore, the lower housing part can comprise a latch opening.

In a further advantageous embodiment of the connection adapter, the housing further comprises a communication interface for the wireless transmission of the signals of the programmable logic controller fed to the contact terminals. The technical advantage is thus achieved that potential isolation between the programmable logic controller and a field device to be controlled can be achieved.

The communication interface can be designed for wireless communication via a communication network, for example in accordance with the Bluetooth standard, ZigBee or Wireless Local Area Network.

Furthermore, the field device can comprise a communication interface for receiving the signals of the programmable logic controller.

In a further advantageous embodiment of the connection adapter, the communication interface is arranged inside the housing. The technical advantage that a particularly compact construction of the connection adapter can be achieved is thus achieved.

In a further advantageous embodiment of the connection adapter, the communication interface comprises a transmitting antenna, which is arranged inside the housing or is integrated into a wall of the housing or is arranged on the housing. The technical advantage that the signals of the programmable logic controller fed to the contact terminals can be transmitted efficiently is thus achieved.

FIG. 1 is a schematic view of a connection adapter 100 according to an embodiment. The connection adapter 100 comprises a housing 101, two connection cables 102 and two series terminal connectors 105. Furthermore, a locking device 107 and a labelling element 109 are illustrated.

The series terminal connector 105 can be connected to the housing 101 by means of the connection cable 102. The connection cable 102 can comprise electrical connection lines for electrically connecting the series terminal connector 105 to the housing 101.

The locking device 107 can be designed for locking the housing 101 to a signal interface of a programmable logic controller. Furthermore, the locking device 107 can comprise a locking mechanism or form a locking mechanism.

The labelling element 107 can serve to label the housing 101. Furthermore, the labelling element 107 can be a labelling field.

The connection adapter 100 can be designed for electrically connecting a signal interface of a programmable logic controller to a series terminal. Furthermore, the series terminal can be connected to a field device. The field device can be an actuator or a sensor.

The series terminal connector 105 can be a plug-in connector for series terminals or a 10-pole combi connector.

According to an embodiment, the connection adapter 100 or a front adapter can be connected directly to a 20-pole signal interface or a 20-pole I/O assembly. To this end, each of the connection cables 102 comprises ten electrical connection lines for conducting signals to the series terminal connector 105 or to the combi connector. The electrical connection lines can have a cross-sectional area of 0.5 $mm^2$ in the case of full loading. In addition, up to 1.5 $mm^2$ cross section is possible in the case of partial loading.

According to an embodiment, the housing 101 or an adapter can be plugged onto a signal interface of a programmable logic controller. Furthermore, the housing 101 or the adapter can be locked or connected to the signal interface of the programmable logic controller or the assembly by means of the locking device 107 or via the locking mechanism. The series terminal connector 105 or the combi connector can be connected to a series terminal or plugged onto a series terminal.

According to an embodiment, the series terminal connector 105 or the combi connector can be labelled to distinguish the allocation of an electrical connection line to a contact pin of the series terminal connector 105 or of the combi connector and/or can be wired according to a color coding or a color code, for example according to a color coding according to the DIN 47100 standard.

According to an embodiment, the connection adapter 100 can be designed to transmit signals with a voltage of up to 250V direct current and/or alternating current. Furthermore, the electrical connection lines can be designed to transmit signals at a temperature of 40° C. with a current value of up to 6 A, and to transmit signals at a temperature of 60° C. with a current value of up to 4 A. Furthermore, the connection cables 102 can be designed to transmit signals at a temperature of 40° C. with a total current value of up to 20 A and to transmit signals at a temperature of 60° C. with a total current value of up to 16 A. The connection cables 102 can be of any given length. For example, the length of the connection cables 102 is between 0.5 m and 1.0 m. Furthermore, the series terminal connectors 105 or the combi plug-in connector can each comprise ten connection poles.

Figure 2:
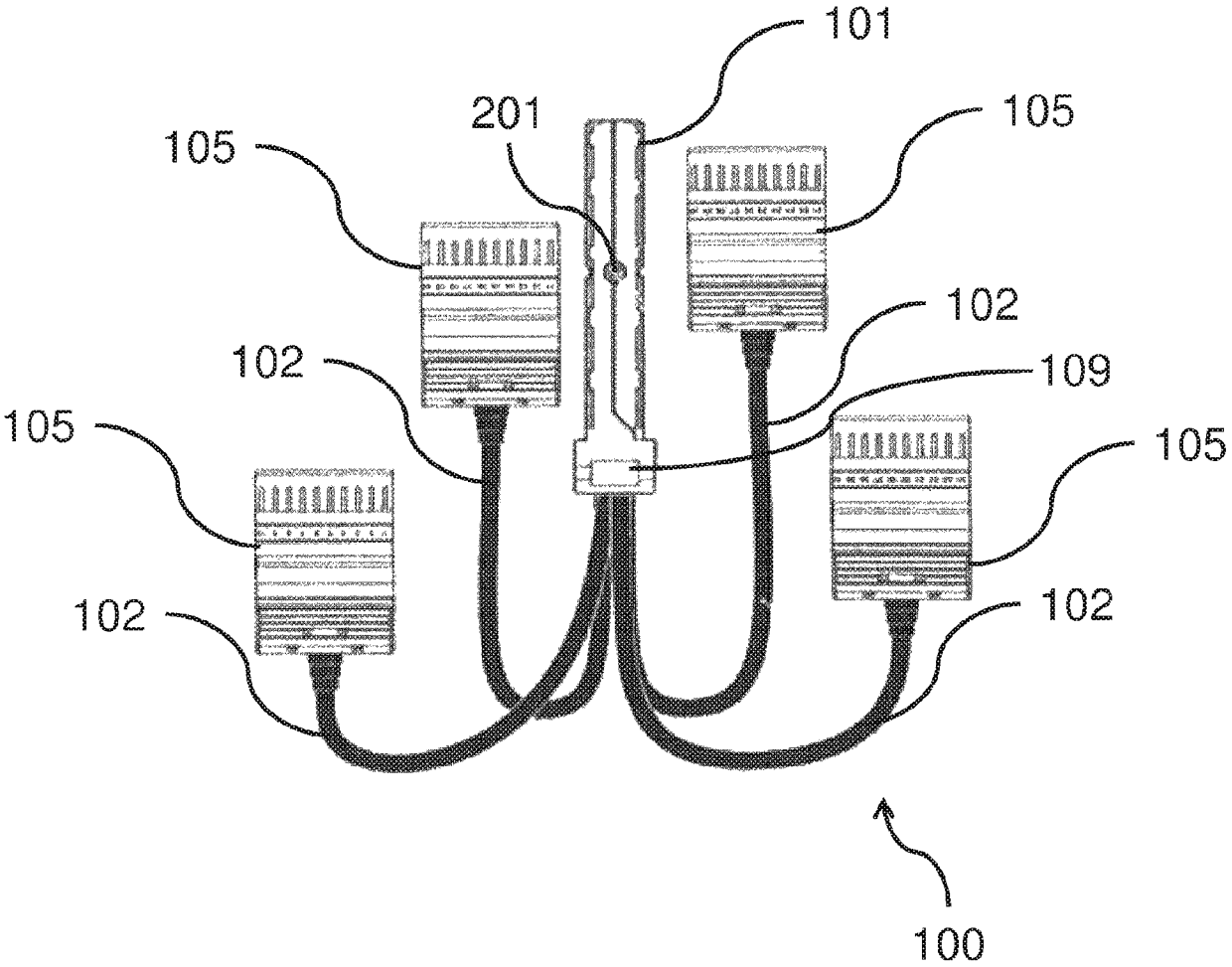
FIG. 2 is a schematic view of a connection adapter according to an embodiment.

FIG. 2 is a schematic view of a connection adapter 100 according to an embodiment. The connection adapter 100 comprises a housing 101, four connection cables 102 and four series terminal connectors 105. Furthermore, a labelling element 109 and a screw element 201 are illustrated.

The screw element 201 can be designed for an interlocking connection of the housing 101 to a signal interface of a programmable logic controller. Furthermore, the screw element 201 can be a fastening screw.

According to an embodiment, the connection adapter 100 or a front adapter can be connected directly to a 40-pole signal interface or a 40-pole I/O assembly. To this end, each of the connection cables 102 or the cables can comprise ten electrical connection lines for conducting signals to the series terminal connector 105 or to the combi connector. The electrical connection lines can have a cross-sectional area of 0.5 $mm^2$ in the case of full loading. Moreover, up to 1.5 $mm^2$ is possible in the case of partial loading.

According to an embodiment, the housing 101 or an adapter can be plugged onto a signal interface of a programmable logic controller. Furthermore, the housing 101 or the adapter can be connected to the signal interface of the programmable logic controller or the assembly by means of the screw element 201 or of the fastening screw.

Figure 3B:
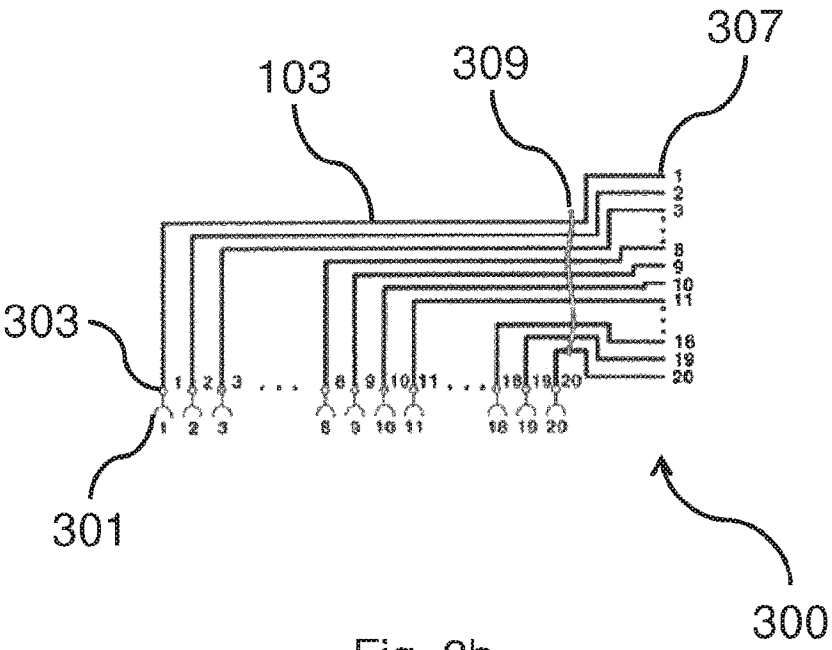
FIG. 3*b* is a schematic circuit diagram of a connection adapter according to an embodiment.
Figure 3A:
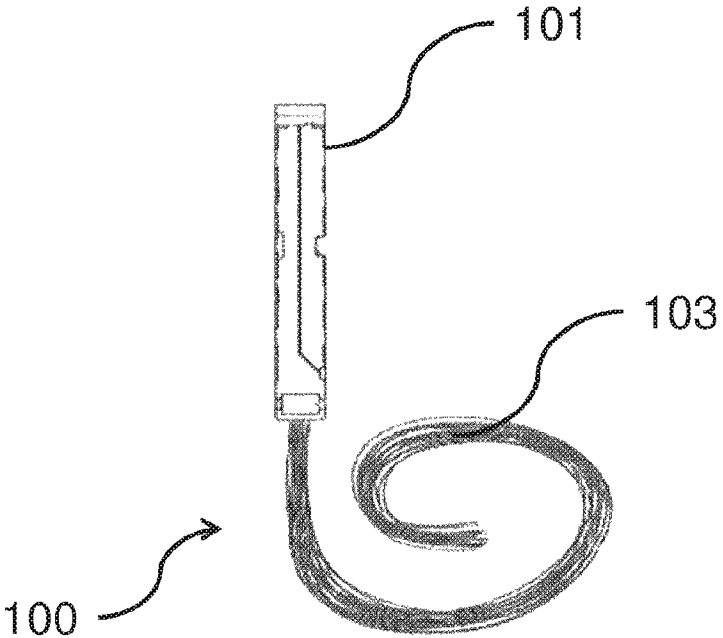
FIG. 3*a* is a schematic view of a connection adapter according to an embodiment.

FIG. 3*a* is a schematic view of a connection adapter 100 according to an embodiment. The connection adapter 100 comprises a housing 101 and electrical connection lines 103.

The connection adapter 100 can be designed for electrically connecting a signal interface of a programmable logic controller to a field device. Furthermore, twenty electrical connection lines 103 can be passed out of the housing 101.

FIG. 3*b* is a schematic circuit diagram 300 of a connection adapter 100 according to an embodiment. The circuit diagram 300 comprises connections 301, connections 303, electrical connection lines 103, connections 307 and a plurality of cable ties 309.

The circuit diagram 300 shows the wiring of the connection adapter 100 shown in FIG. 3*a*. To this end, the circuit diagram 300 comprises twenty identically wired electrical connection lines 103, which can be mechanically connected to one another by means of the cable tie 309.

The connection 301 can be an electrical connection for electrically connecting to an electrical contact pin of a programmable logic controller. For example, the connection 301 is an element of a contact terminal. Furthermore, the connection 301 is electrically connected to the connection 303. The connection 303 can be an electrical connection for electrically connecting to the electrical connection line 103. For example, the connection 303 is an element of the contact terminal. Furthermore, the connection 303 is electrically connected to the connection 307. The connection 307 can be a core end of the electrical connection line 103.

Figure 4B:
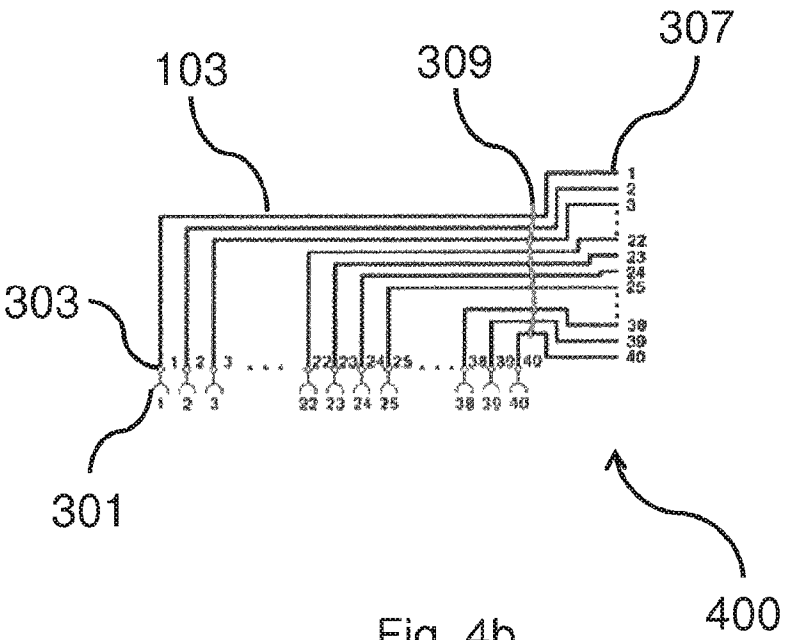
FIG. 4*b* is a schematic circuit diagram of a connection adapter according to an embodiment.
Figure 4A:
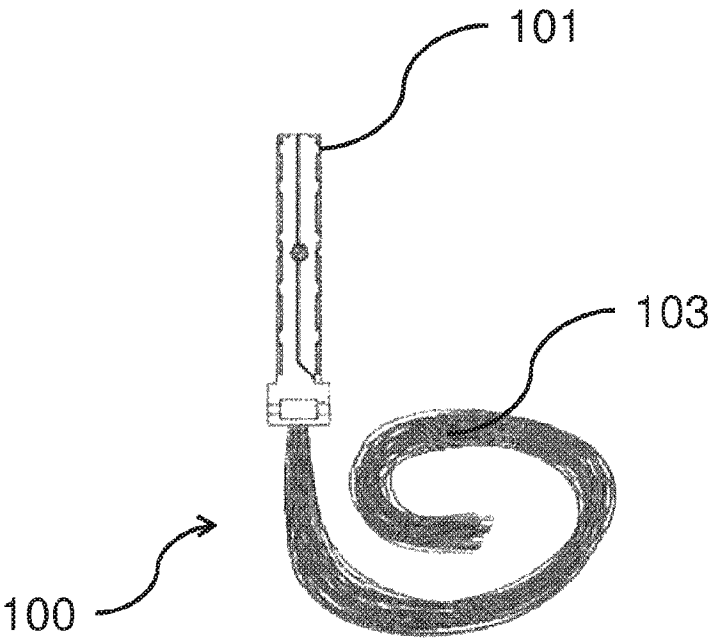
FIG. 4*a* is a schematic view of a connection adapter according to an embodiment.

FIG. 4*a* is a schematic view of a connection adapter 100 according to an embodiment. The connection adapter 100 comprises a housing 101 and electrical connection lines 103.

The connection adapter 100 can be designed for electrically connecting a signal interface of a programmable logic controller to a field device. Furthermore, forty electrical connection lines 103 can be passed out of the housing 101.

FIG. 4*b* is a schematic circuit diagram 400 of a connection adapter 100 according to an embodiment. The circuit plan 400 comprises connections 301, connections 303, electrical connection lines 103, connections 307 and a cable tie 309.

The circuit diagram 400 shows the wiring of the connection adapter 100 shown in FIG. 4*a*. To this end, the circuit diagram 400 comprises forty identically wired electrical connection lines 103, which can be mechanically connected to one another by means of the cable tie 309.

The connection 301 can be an electrical terminal for electrically connecting to an electrical contact pin of a programmable logic controller. For example, the connection 301 is an element of a contact terminal. Furthermore, the connection 301 is electrically connected to the connection 303. The connection 303 can be an electrical connection for electrically connecting to the electrical connection line 103. For example, the connection 303 is an element of the contact terminal. Furthermore, the connection 303 is electrically connected to the connection 307. The connection 307 can be a core end of the electrical connection line 103.

Figure 5:
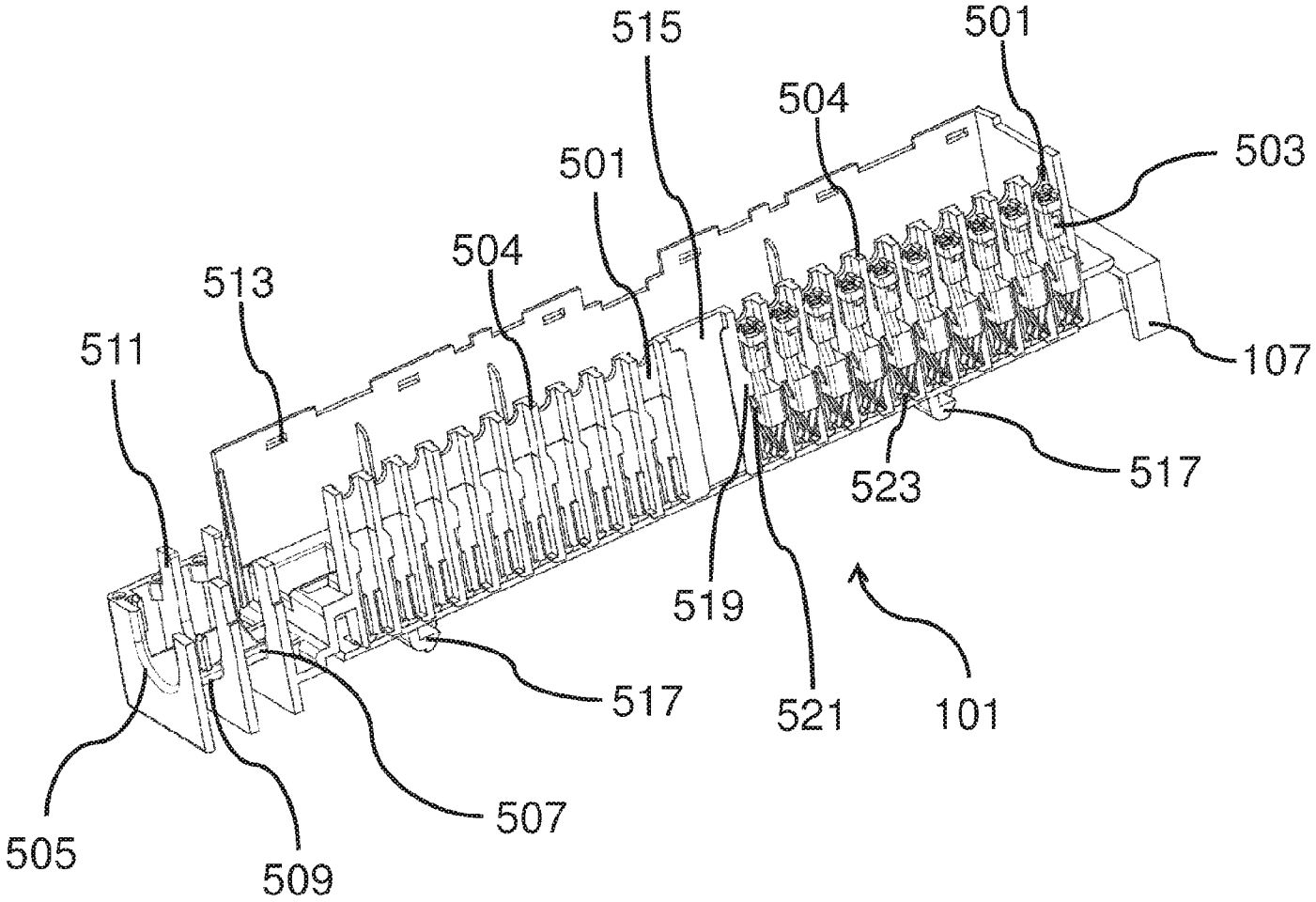
FIG. 5 is a perspective view of an opened housing of a connection adapter according to an embodiment.

FIG. 5 is a perspective view of an opened housing 101 of a connection adapter 100 according to an embodiment. The housing 101 comprises contact chambers 501, contact terminals 503, insulating elements 504, a housing opening 505, a fastening device 507, a further fastening device 509, a separating device 511, latch openings 513, a guiding device 515 and locking elements 517. Furthermore, the contact chambers 501 each have a snap-on catch 519 and the contact terminals 503 each comprise a catch spring 521 and a spring-loaded terminal 523.

The housing 101 comprises twenty contact chambers 501 arranged in rows, each contact terminal 503 being accommodated in one of ten contact chambers 501. Furthermore, according to a further embodiment, each contact terminal 503 can be accommodated in one of the contact chambers 501. Furthermore, each insulating element 504 is arranged between two respectively adjacent contact chambers 501.

The connection adapter 100 for transmitting signals of a programmable logic controller, the programmable logic controller comprising a signal interface with electrical contact pins arranged in rows, can be designed with: contact terminals 503 for electrically contacting the electrical contact pins of the signal interface, each contact terminal 503 being designed for receiving one electrical contact pin of the signal interface; contact chambers 501 for receiving the contact terminals 503, each contact terminal 503 being arranged in one contact chamber 501, and the contact chambers 501 being arranged in rows, and insulating elements 504 being arranged between adjacent contact chambers 501 for increasing a dielectric strength; and a housing 101 in which the contact terminals 503 and the contact chambers 501 are received, the housing 101 being closed and electrically insulated.

The signals can be analogue or digital signals for controlling a field device. The field device can be an actuator or a sensor. Furthermore, the programmable logic controller can be a programmable device for controlling the field device.

The signal interface can be designed for inputting and outputting the signals for controlling the field device. To this end, the signal interface comprises electrical contact pins arranged in rows. For example, the signal interface comprises ten contact pins arranged in rows for controlling the field device. In the process, two contact pins can be used for the power supply of the field device. The remaining eight contact pins can be used for inputting and outputting the signals for controlling the field device. Furthermore, the signal interface can be designed for controlling a plurality of field devices. For example, the signal interface comprises two, three, four, five, ten, fifteen or twenty connections of contact pins, each connection of contact pins being provided for controlling one field device.

The electrical contact pins can be connection pins. Furthermore, the quantity of the contact pins 503 can be less than or equal to the quantity of contact chambers 501.

Each contact pin 503 can comprise a spring-loaded terminal 523 for receiving an electrical contact pin of the signal interface.

The contact chambers 501 can be arranged in a plurality of rows, it being possible for adjacent rows to be separated from one another by a guiding device 515. For example, the contact chambers can be arranged in two, three, four, five, ten, fifteen or twenty rows.

Each contact terminal 503 can be mechanically fixable in one contact chamber 501 by means of a snap-in connection. To this end, each contact terminal 503 can comprise a catch spring 521 and each contact chamber 501 can comprise a snap-on catch 519.

The housing 101 can be constructed so as to be electric-shock-proof for a user. For example, the housing 101 is electric-shock-proof against access with a finger according to the IP20 standard. Furthermore, the housing 101 can comprise glass-fiber-reinforced plastics material.

The insulating elements 504 can be formed by elements of the housing 101. For example, the insulating elements 504 are formed by webs of the housing 101, which separate adjacent contact chambers 501 in an electrically insulating manner.

The housing opening 505 can be designed to pass electrical connection lines out of the housing 101.

Furthermore, the housing 101 can comprise the fastening device 507 for fastening a tension relief device. The fastening device 507 can be formed by a web of the housing 101. Furthermore, the tension relief device can be formed by a cable tie.

Furthermore, the housing 101 can comprise the further fastening device 509 for fastening a tension relief device, and the fastening device 507 and the further fastening device 509 can be separated by a separating device 511. The further fastening device 509 can be formed by a web of the housing 101. The separating device 511 can be formed by a web of the housing 101.

The housing 101 can be lockable to the signal interface. To this end, the housing 101 can comprise a locking element 517, for example a latching hook or a locking latch. Furthermore, the signal interface can comprise a latch opening.

Furthermore, the housing 101 can consist of a plurality of housing parts, for example of a lower housing part and a housing cover. To fasten the housing parts, the housing 101 can comprise a latch opening 513.

Figure 6:
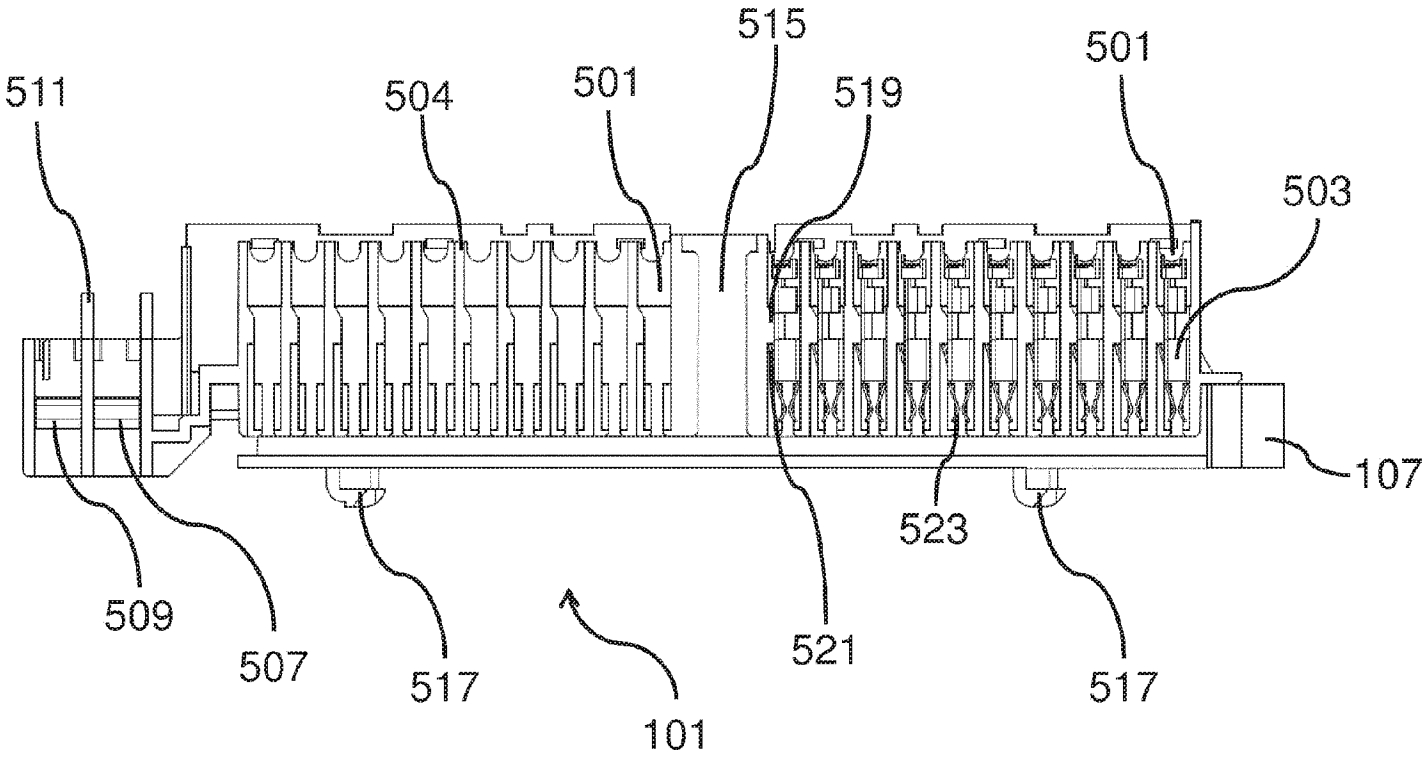
FIG. 6 is a side view of an opened housing of a connection adapter according to an embodiment.

FIG. 6 is a side view of an opened housing 101 of a connection adapter 100 according to an embodiment. The housing 101 comprises contact chambers 501, contact terminals 503, insulating elements 504, a fastening device 507, a further fastening device 509, a separating device 511, a guiding device 515 and locking elements 517. Furthermore, the contact chambers 501 each comprise a snap-on catch 519 and the contact terminals 503 each comprise a catch spring 521 and a spring-loaded terminal 523.

The housing 101 shown in FIG. 6 is equivalent to the housing 101 shown in FIG. 5.

Figure 7:
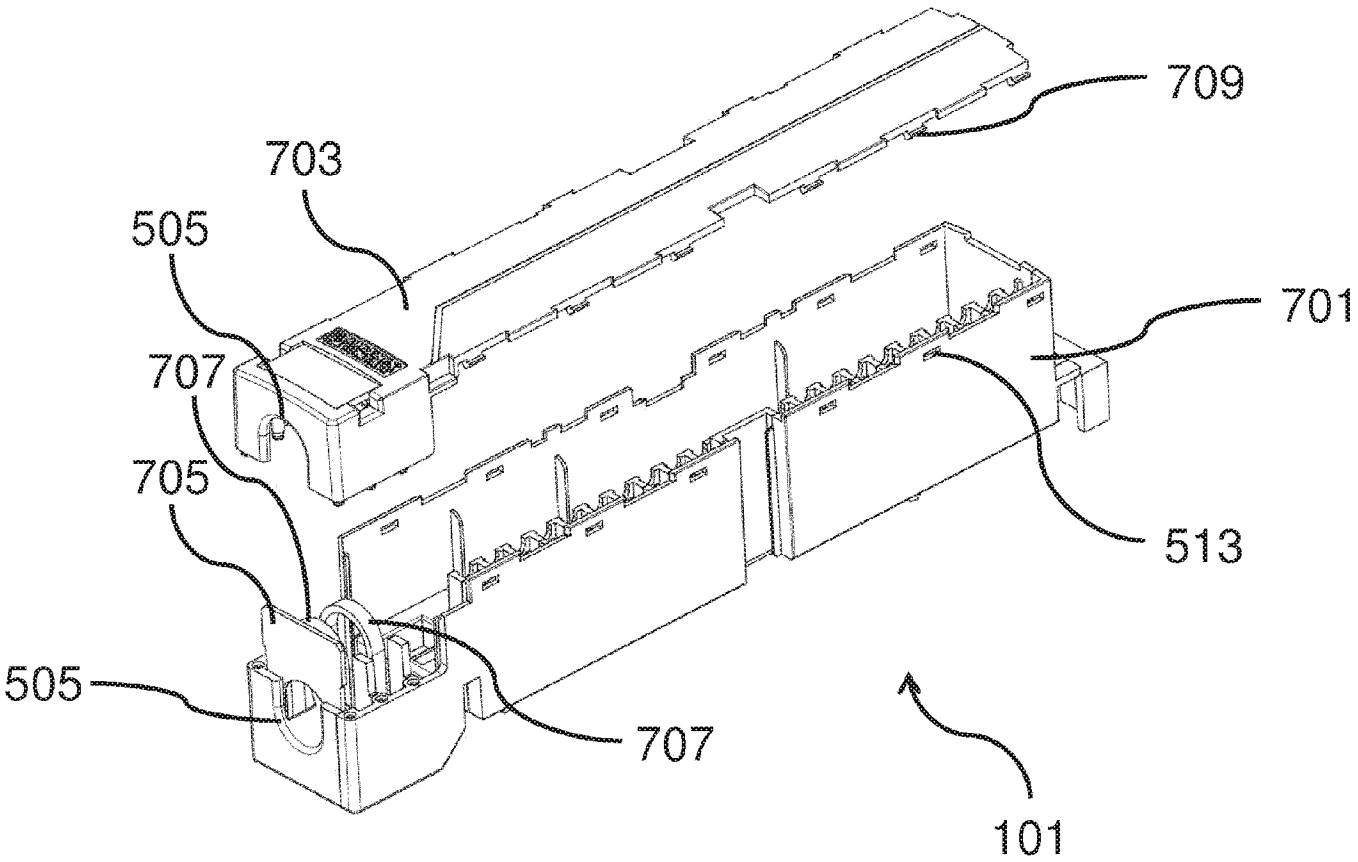
FIG. 7 is an exploded view of a housing of a connection adapter according to an embodiment.

FIG. 7 is an exploded view of a housing 101 of a connection adapter 100 according to an embodiment. The housing 101 comprises a lower housing part 701, a housing cover 703, a housing opening 505, a closing element 705, two tension relief devices 707, latching hooks 709 and latch openings 513.

The housing 101 can comprise a lower housing part 701, in which the contact terminals and the contact chambers are accommodated, and a housing cover 703. Furthermore, the housing cover 703 can be lockable to the lower housing part 701. To this end each latching hook 709 can be inserted into one latch opening 513.

The connection adapter 100 can further comprise a flat closing element 705 for closing the housing opening 505 for passing the electrical connection lines out of the housing 101. The housing opening 505 can be formed by a recess in the lower housing part 701 and/or a recess in the housing cover 703.

The tension relief devices 707 can be formed by cable ties. Furthermore, the tension relief devices 707 can be fastened to fastening devices of the housing 101.

Figure 8B:
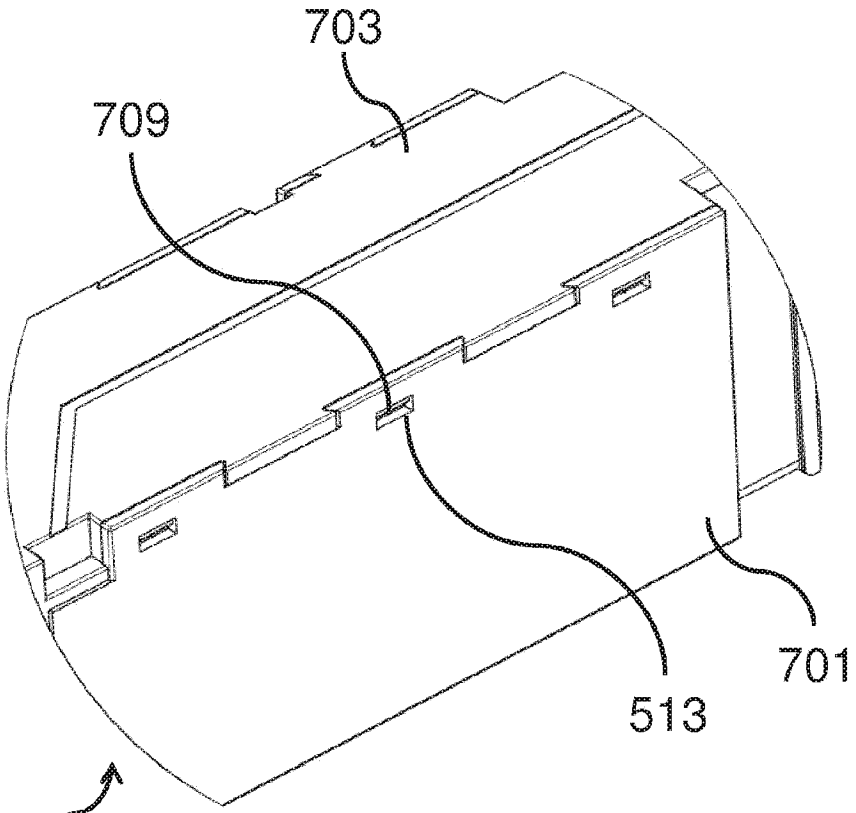
FIG. 8*b* shows an enlargement of a portion of a housing of a connection adapter according to an embodiment.
Figure 8A:
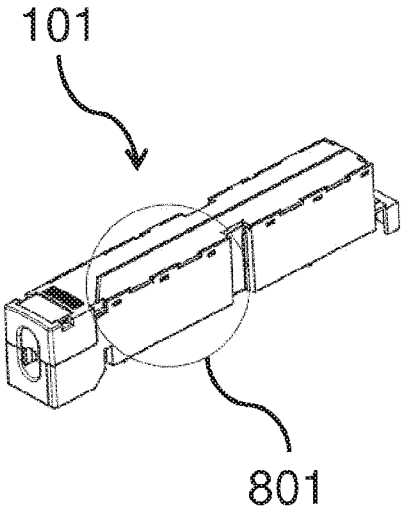
FIG. 8*a* is a perspective view of a housing of a connection adapter according to an embodiment.

FIG. 8*a* is a perspective view of a housing 101 of a connection adapter 100 according to an embodiment. Furthermore, a portion 801 is illustrated which is shown in an enlarged manner in FIG. 8*b*.

FIG. 8*b* is an enlargement of a portion 801 of a housing 101 of a connection adapter 100 according to an embodiment. The portion 801 comprises a lower housing part 701, a housing cover 703, latching hooks 709 and latch openings 513.

Each latching hook 709 can be inserted into one latch opening 513 in order to lock the lower housing part 701 to the housing cover 703.

Figure 9:
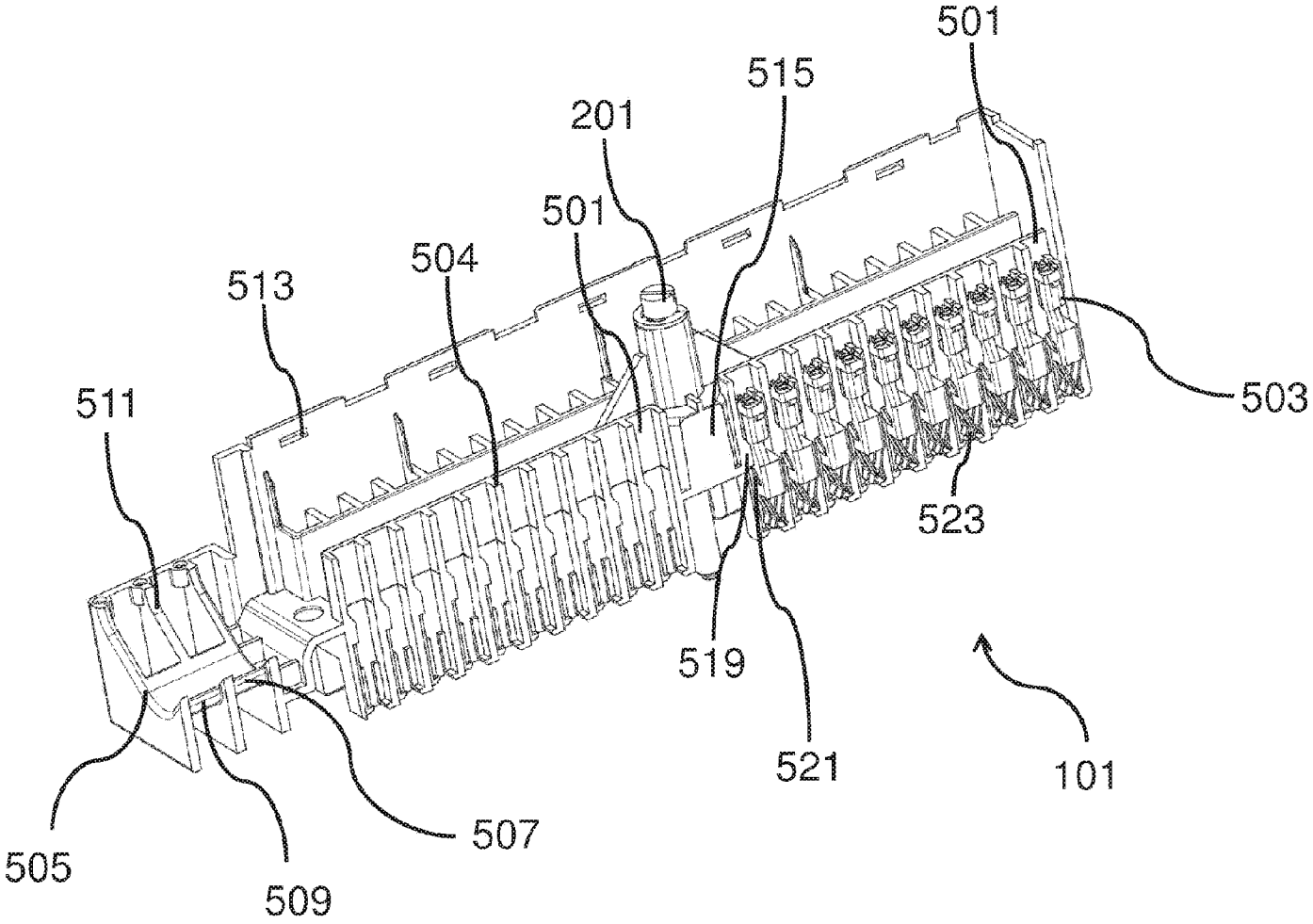
FIG. 9 is a perspective view of an opened housing of a connection adapter according to an embodiment.

FIG. 9 is a perspective view of an opened housing 101 of a connection adapter 100 according to an embodiment. The housing 101 comprises contact chambers 501, contact terminals 503, insulating elements 504, a housing opening 505, a fastening device 507, a further fastening device 509, a separating device 511, a screw element 201, latch openings 513 and a guiding device 515. Furthermore, the contact chambers 501 each comprise a snap-on catch 519 and the contact terminals 503 each comprise a catch spring 521 and a spring-loaded terminal 523.

The housing 101 comprises forty contact chambers 501 arranged in rows, each contact terminal 503 being accommodated in one of ten contact chambers 501. Furthermore, according to a further embodiment, one contact terminal 503 can be accommodated in each of the contact chambers 501. Furthermore, an insulating element 504 is arranged between each two adjacent contact chambers 501.

The housing 101 can be connectable to the signal interface in a force-locked manner, in particular by means of a screw connection. Furthermore, the housing 101 can comprise a screw element 201, for example a transit screw or a fixing screw, for producing the screw connection. The signal interface can comprise a screw thread, into which the screw element 210 can be introduced.

Figure 10:
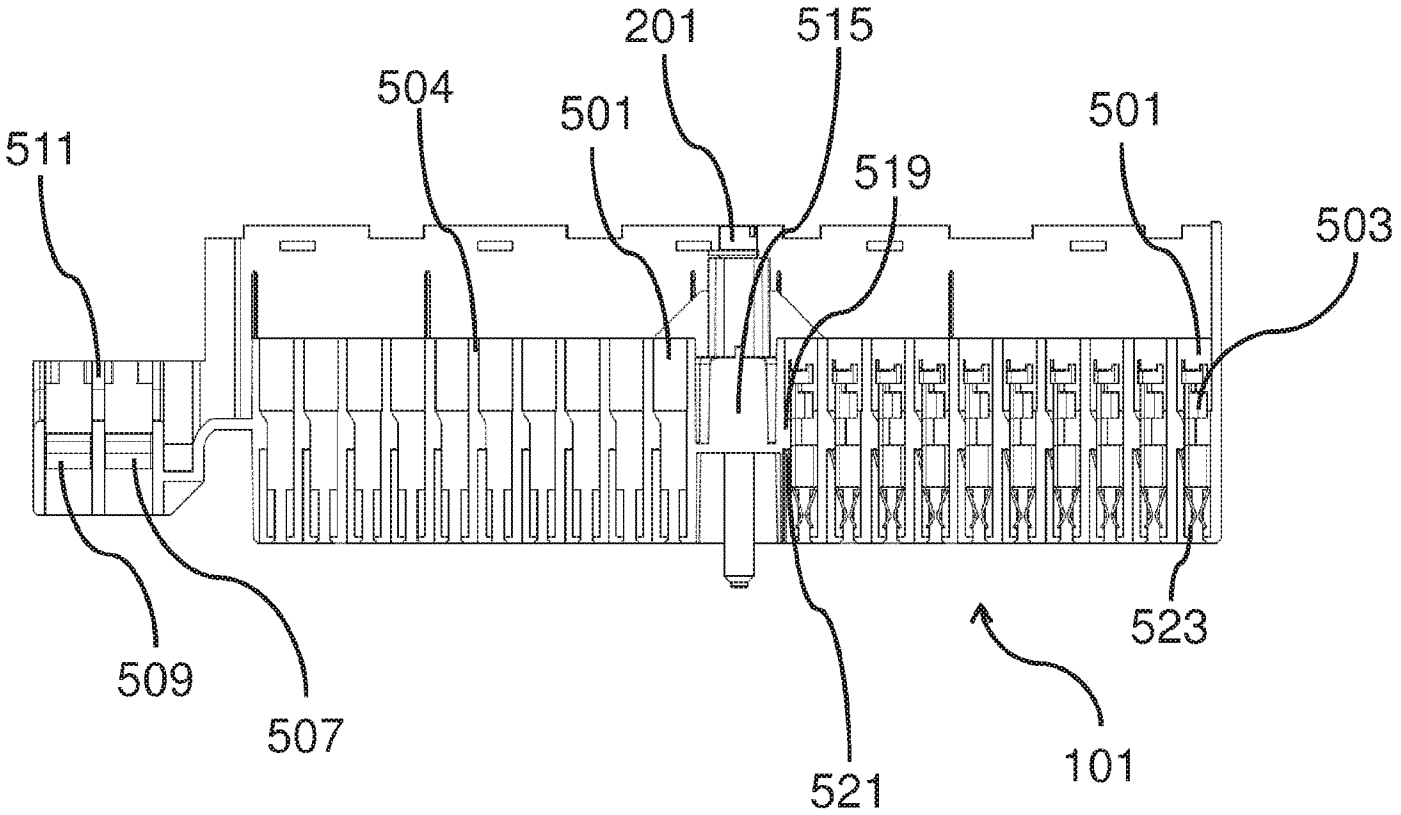
FIG. 10 is a side view of an opened housing of a connection adapter according to an embodiment.

FIG. 10 is a side view of an opened housing 101 of a connection adapter 100 according to an embodiment. The housing 101 comprises contact chambers 501, contact terminals 503, insulating elements 504, a fastening device 507, a further fastening device 509, a separating device 511, a screw element 201 and a guiding device 515. Furthermore, the contact chambers 501 each comprise a snap-on catch 519 and the contact terminals 503 each comprise a catch spring 521 and a spring-loaded terminal 523.

The housing 101 shown in FIG. 10 is equivalent to the housing 101 shown in FIG. 9.

Figure 11:
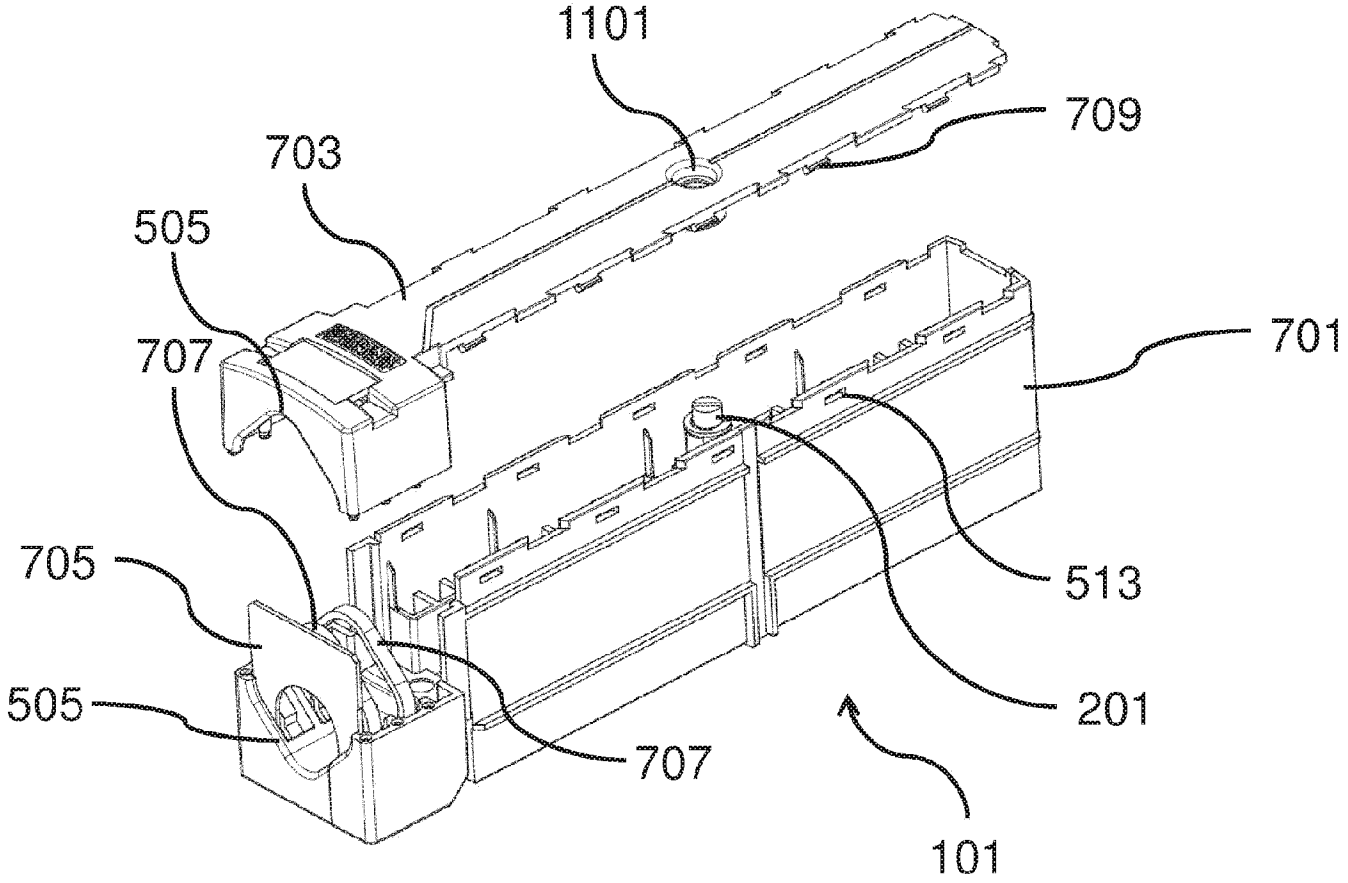
FIG. 11 is an exploded view of a housing of a connection adapter according to an embodiment.

FIG. 11 is an exploded view of a housing 101 of a connection adapter 100 according to an embodiment. The housing 101 comprises a lower housing part 701, a housing cover 703, a housing opening 505, a closing element 705, two tension relief devices 707, a latching hook 709, a latch opening 513, a screw element 201 and an opening 1101.

The screw element 201 can be partially accommodated in the opening 1101, in order to allow access to the screw element 201, for example by means of the tip of a screwdriver.

Figure 12:
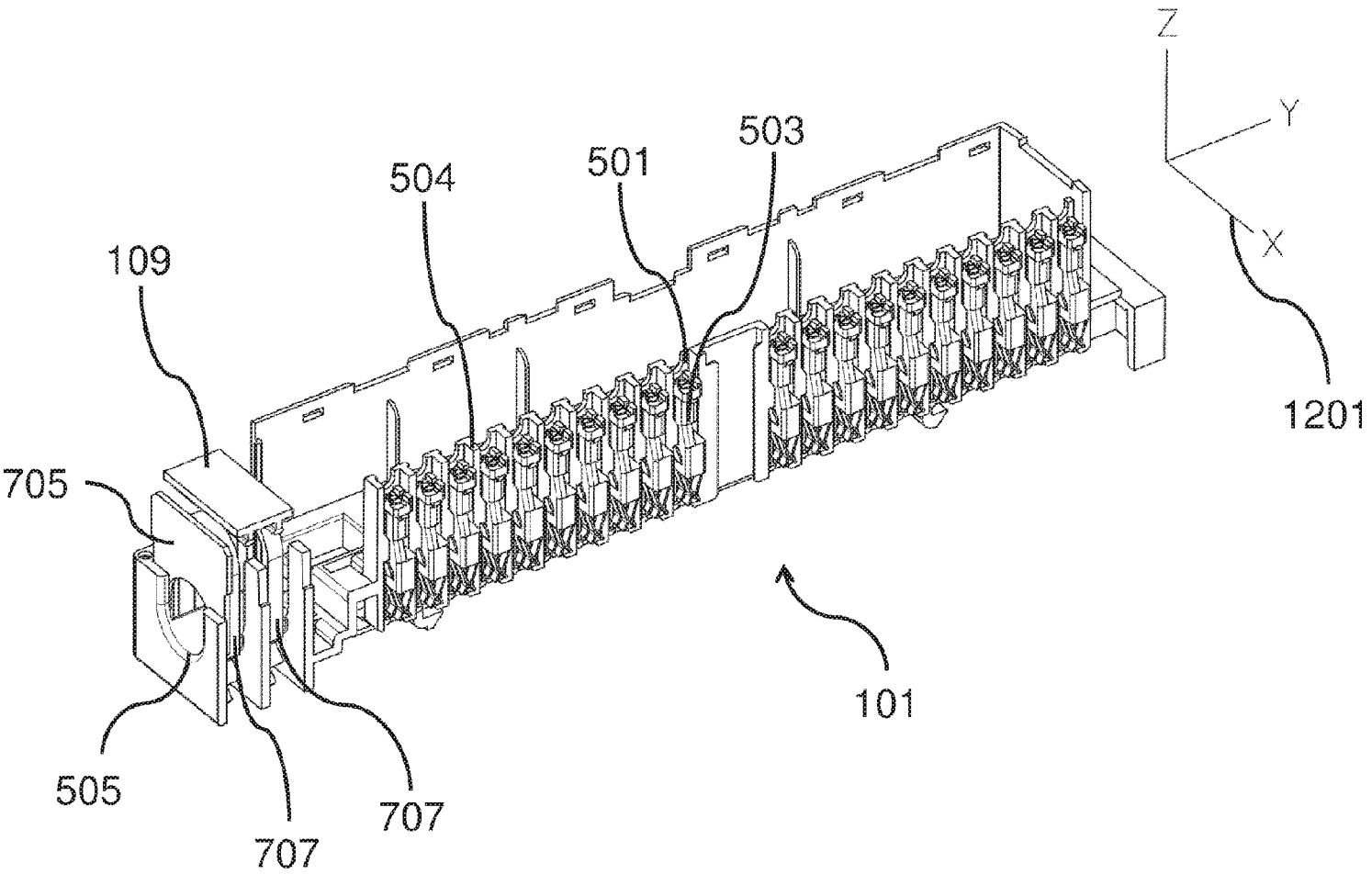
FIG. 12 is a perspective view of an opened housing of a connection adapter according to an embodiment.

FIG. 12 is a perspective view of an opened housing 101 of a connection adapter 100 according to an embodiment. The housing 101 comprises contact chambers 501, contact terminals 503, insulating elements 504, a housing opening 505, a closing element 705, two tension relief devices 707 and a labelling element 109. Furthermore, a Cartesian coordinate system 1201 is illustrated.

The housing 101 comprises twenty contact chambers 501 arranged in rows, each contact terminal 503 being accommodated in one contact chamber 501. Furthermore, an insulating element 504 is arranged between each two adjacent contact chambers 501.

The labelling element 109 can be a labelling plate or a labelling field.

Figure 13B:
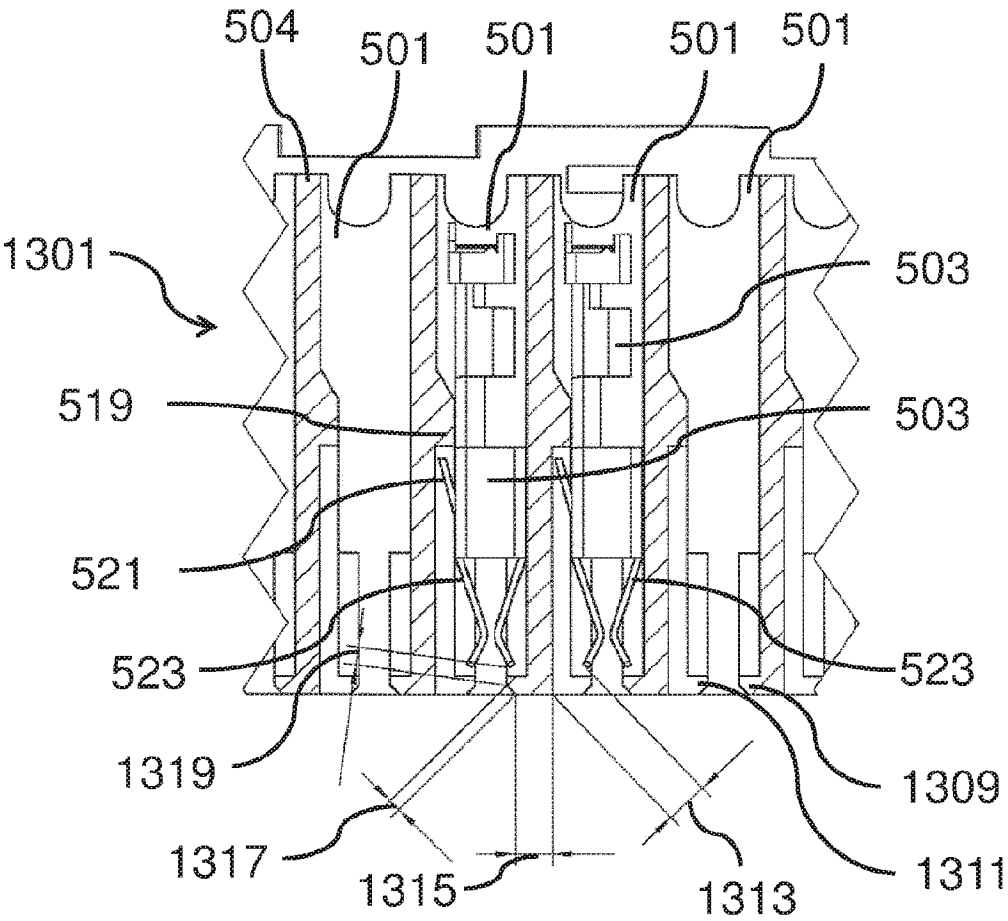
FIG. 13*b* is a side view of a portion of an opened housing of a connection adapter according to an embodiment.
Figure 13A:
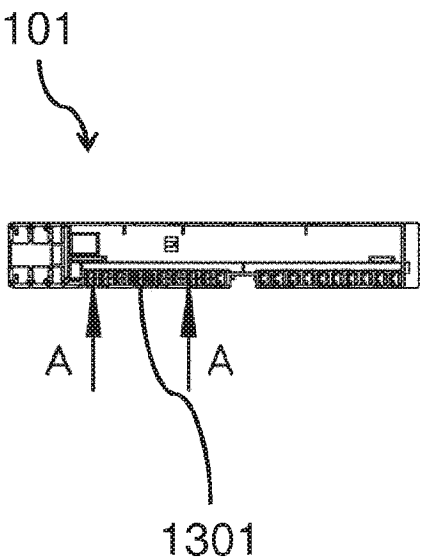
FIG. 13*a* is a plan view of a housing of a connection adapter according to an embodiment.

FIG. 13*a* is a plan view of a housing 101 of a connection adapter 100 according to an embodiment. Furthermore, a portion 1301 is illustrated of which a side view is shown in FIG. 13*b*.

FIG. 13*b* is a side view of a portion 1301 of an opened housing 101 of a connection adapter 100 according to an embodiment. The portion 1301 comprises contact chambers 501, contact terminals 503, insulating elements 504, catch springs 521, snap-on catches 519, spring-loaded terminals 523, protruding portions 1309 and 1311 as well as distances 1313 to 1319.

Furthermore, the insulating elements 504 can comprise protruding portions 1309 and 1311 for increasing an electrical creepage path.

The distances 1313 to 1319 can be air gaps and creepage paths. For example, the distance 1313 is 1.94 mm, the distance 1315 is 1.63 mm, the distance 1317 is 0.57 mm and the distance 1319 is 0.81 mm. The air gap and creepage path formed by the distances 1317 to 1319 is, for example, 0.8 mm+0.5 mm+1.6 mm+1.9 mm=4.8 mm.

Figure 14B:
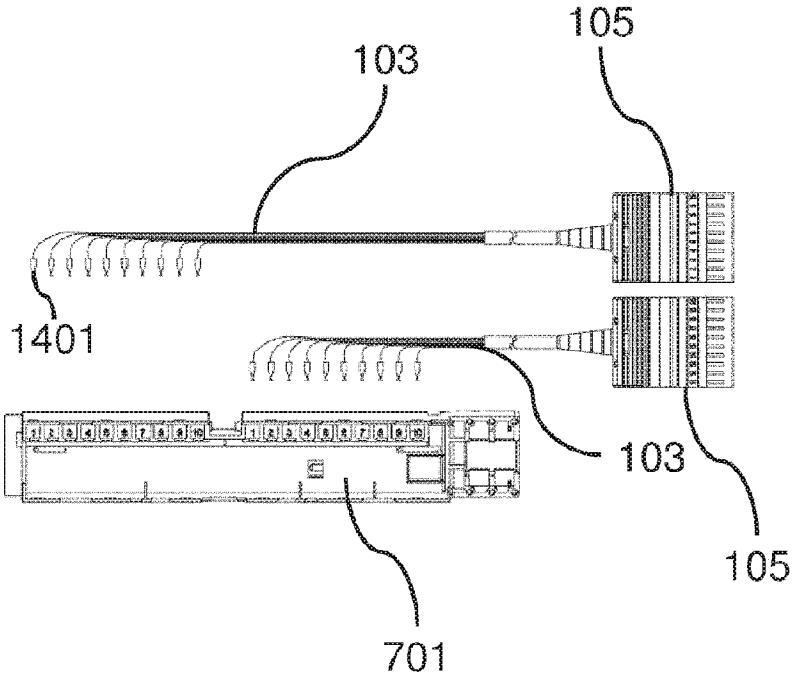
FIG. 14*b* is an arrangement for carrying out an assembly step of a housing of a connection adapter according to an embodiment.
Figure 14A:
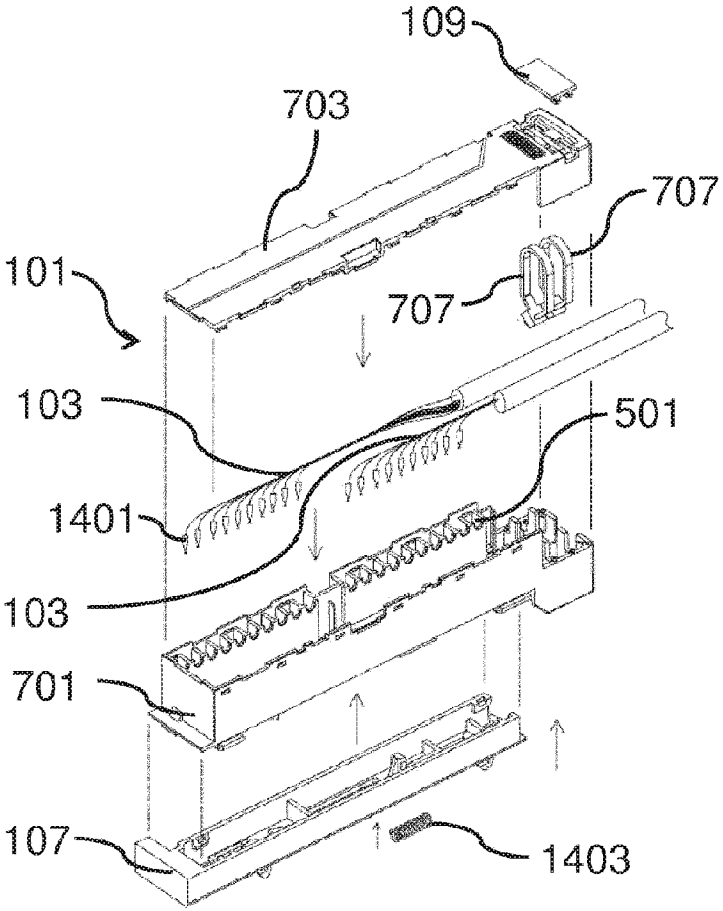
FIG. 14*a* is an exploded view of a housing of a connection adapter according to an embodiment.

FIG. 14*a* is an exploded view of a housing 101 of a connection adapter 100 according to an embodiment. The housing 101 comprises a lower housing part 701, a housing cover 703, two tension relief devices 707, electrical connection lines 103, a locking device 107, contact elements 1401, a latch spring 1403 and a labelling element 109. Furthermore, the lower housing part 701 comprises contact chambers 501.

The contact element 1401 can be a crimp contact. Furthermore, each contact element 1401 can be arranged on one core end of an electrical connection line 103. Each contact element 1401 can be locked to one contact chamber 501 by means of a crimp connection.

The latch spring 1403 can be an element of the locking device 107. Furthermore, the locking device 107 can comprise a locking mechanism. The labelling element 109 can be a labelling plate or a labelling field.

The elements illustrated in FIG. 14*a* can be joined together in order to provide a connection adapter 100.

FIG. 14*b* shows an arrangement for carrying out an assembly step of a housing 101 of a connection adapter 100 according to an embodiment. The arrangement comprises a lower housing part 701, electrical connection lines 103, contact elements 1401 and series terminal connectors 105.

The series terminal connectors 105 can be connected to electrical connection lines 103. The electrical connection lines 103 can be inserted from above into the lower housing part 701, for example into contact chambers 501 of the lower housing part 701. In order to assign the electrical connection lines 103 to a terminal of the series terminal connector 105, the electrical connection lines 103 can be marked by means of a color coding or a color code.

Figure 15B:
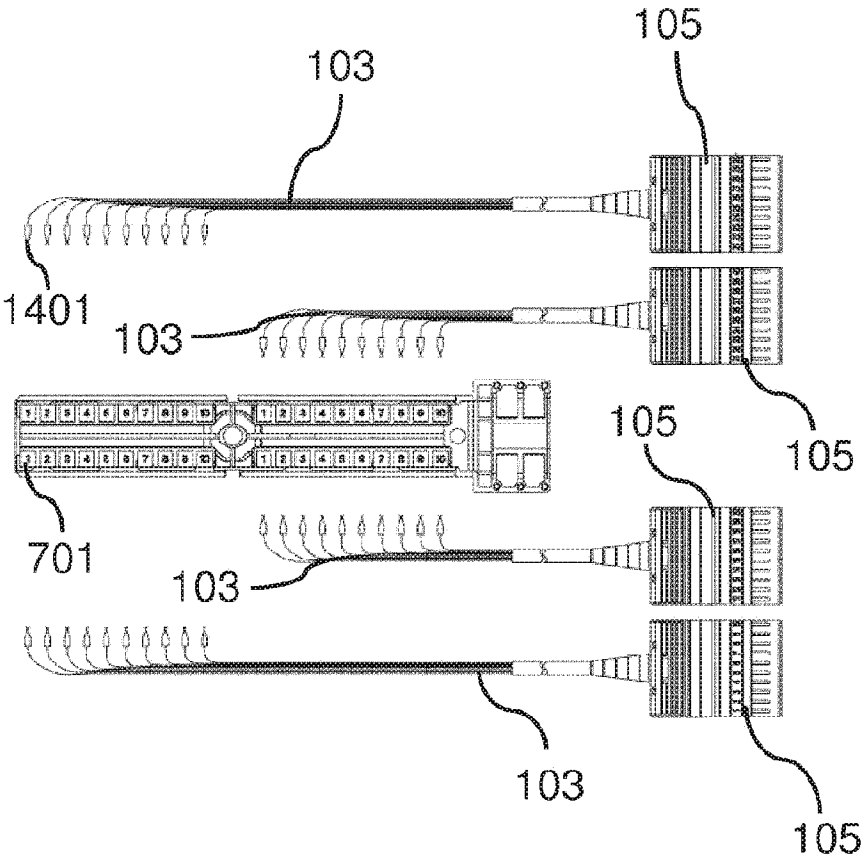
FIG. 15*b* is an arrangement for carrying out an assembly step of a housing of a connection adapter according to an embodiment.
Figure 15A:
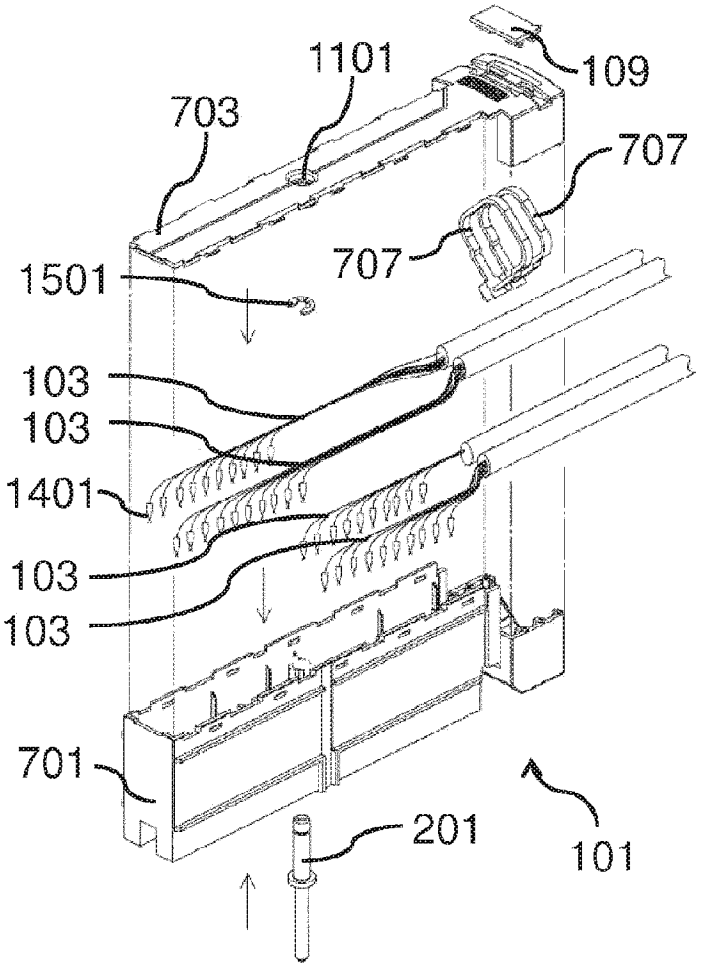
FIG. 15*a* is an exploded view of a housing of a connection adapter according to an embodiment.

FIG. 15*a* is an exploded view of a housing 101 of a connection adapter 100 according to an embodiment. The housing 101 comprises a lower housing part 701, a housing cover 703, two tension relief devices 707, electrical connection lines 103, contact elements 1401, a screw element 201, an opening 1101, a locking washer 1501 and a labelling element 109.

The elements illustrated in FIG. 15*a* can be joined together in order to provide a connection adapter 100.

FIG. 15*b* shows an arrangement for carrying out an assembly step of a housing 101 of a connection adapter 100 according to an embodiment. The arrangement comprises a lower housing part 701, electrical connection lines 103, contact elements 1401 and series terminal connectors 105.

The series terminal connectors 105 can be connected to electrical connection lines 103. The electrical connection lines 103 can be inserted from above into the lower housing part, for example into contact chambers 501 of the lower housing part 701. In order to assign the electrical connection lines 103 to a connection of the series terminal connector 105, the electrical connection lines 103 can be marked by means of a color coding or a color code.

Figure 16B:
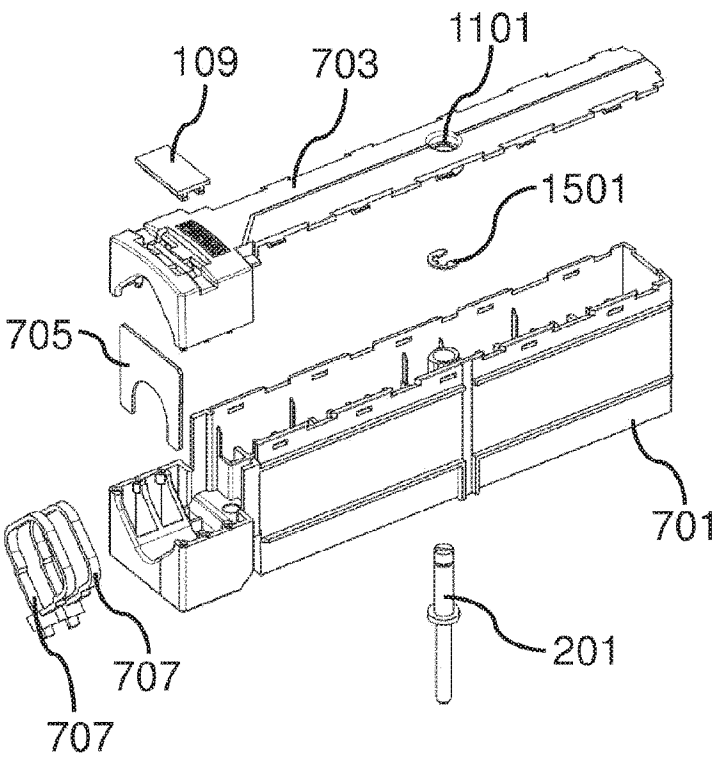
FIG. 16*b* is an exploded view of a housing of a connection adapter according to an embodiment.
Figure 16A:
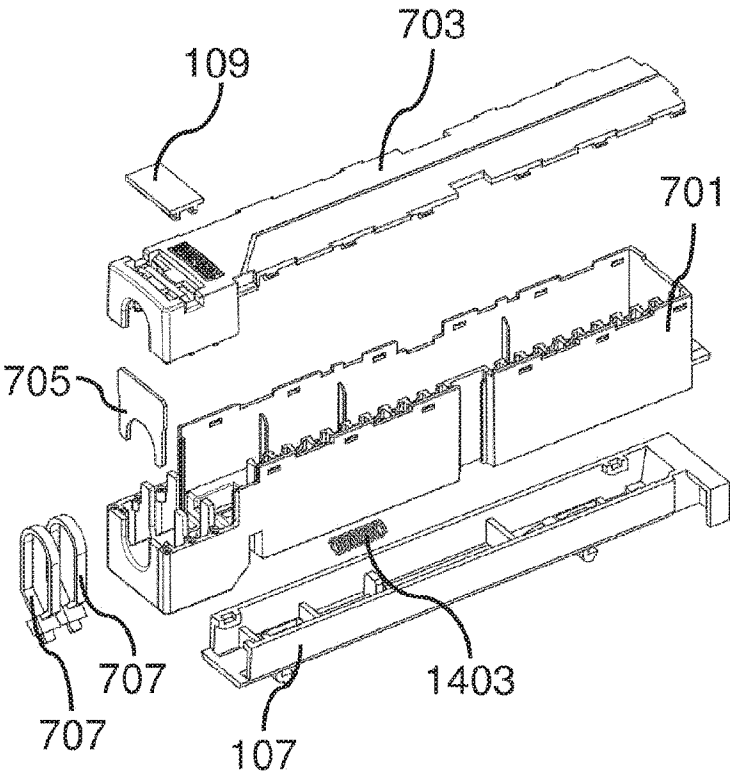
FIG. 16*a* is an exploded view of a housing of a connection adapter according to an embodiment.

FIG. 16*a* is an exploded view of a housing 101 of a connection adapter 100 according to an embodiment. The housing 101 comprises a lower housing part 701, a housing cover 703, two tension relief devices 707, a closing element 705, a locking device 107, a latch spring 1403 and a labelling element 109.

FIG. 16*b* is an exploded view of a housing 101 of a connection adapter 100 according to an embodiment. The housing 101 comprises a lower housing part 701, a housing cover 703, two tension relief devices 707, a closing element 705, a screw element 201, an opening 1101, a locking washer 1501 and a labelling element 109.

Figure 17:
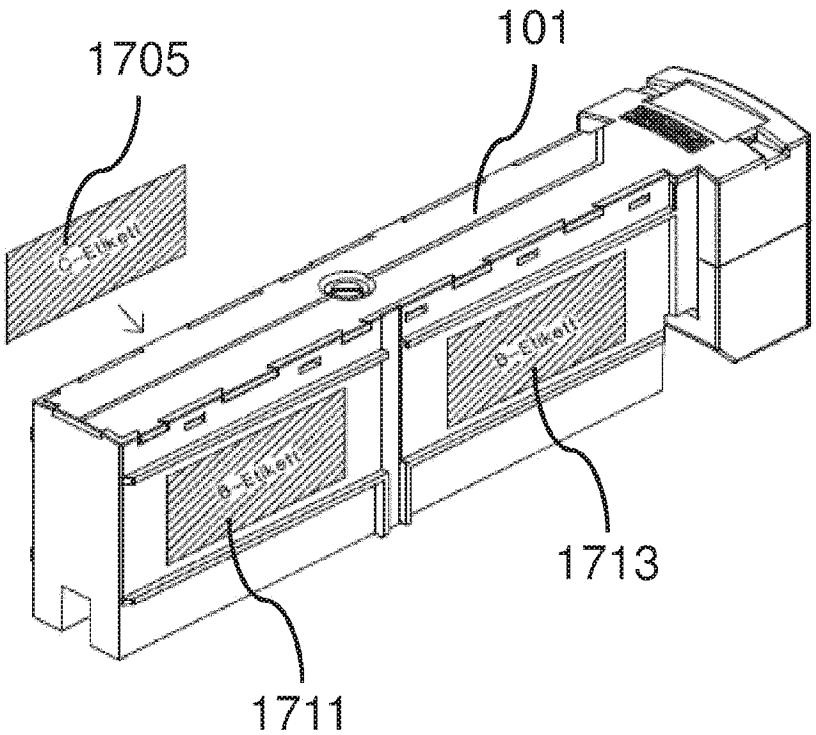
FIG. 17 is a perspective view of a housing of a connection adapter according to an embodiment.

FIG. 17 is a perspective view of a housing 101 of a connection adapter 100 according to an embodiment. In addition, surfaces 1705, 1711 and 1713 are illustrated.

A label for identification, for example a B label, is arranged on each of the surfaces 1711 and 1713. Furthermore, a label for identification, for example a C label, can be arranged on the surface 1705.

Figure 18:
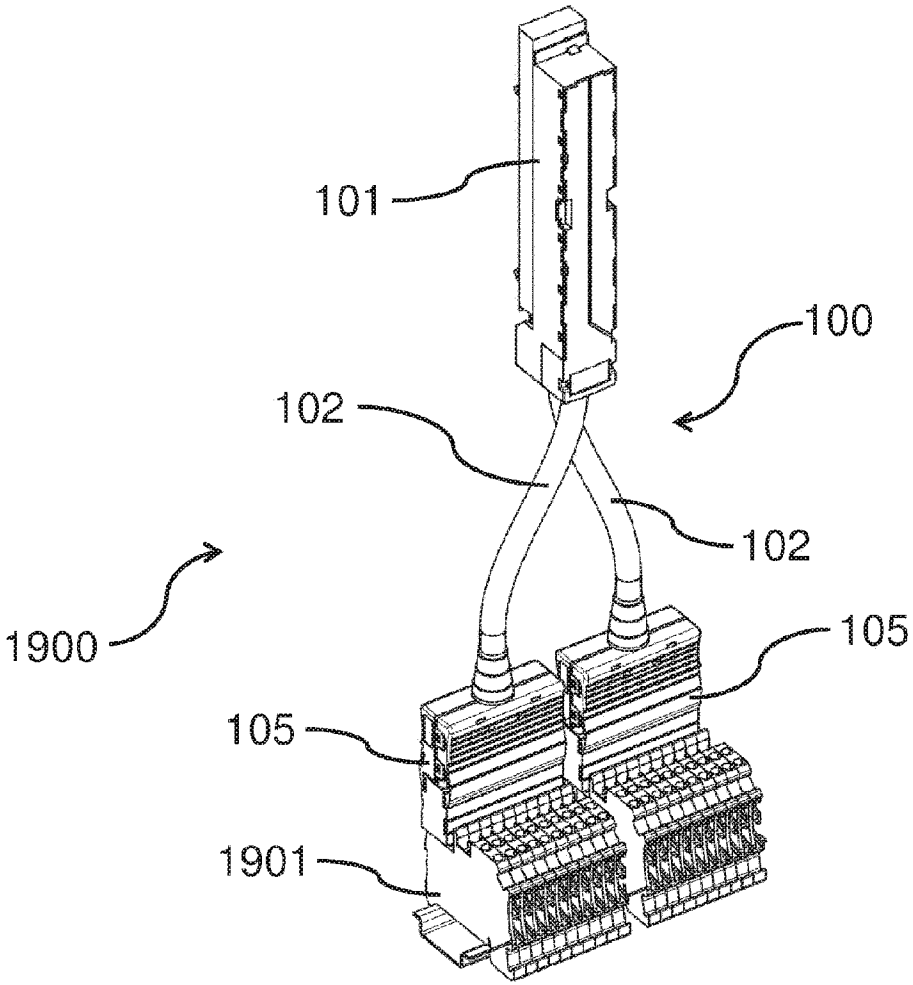
FIG. 18 is a connection arrangement with a connection adapter connection adapter according to an embodiment and with a series terminal.

FIG. 18 shows a connection arrangement 1900 with a connection adapter 100 according to an embodiment and with a series terminal 1901. The connection adapter 100 comprises a housing 101, connection cables 102 and series terminal connectors 105. The series terminal connectors 105 are connected to the series terminal 1901.

Figure 19:
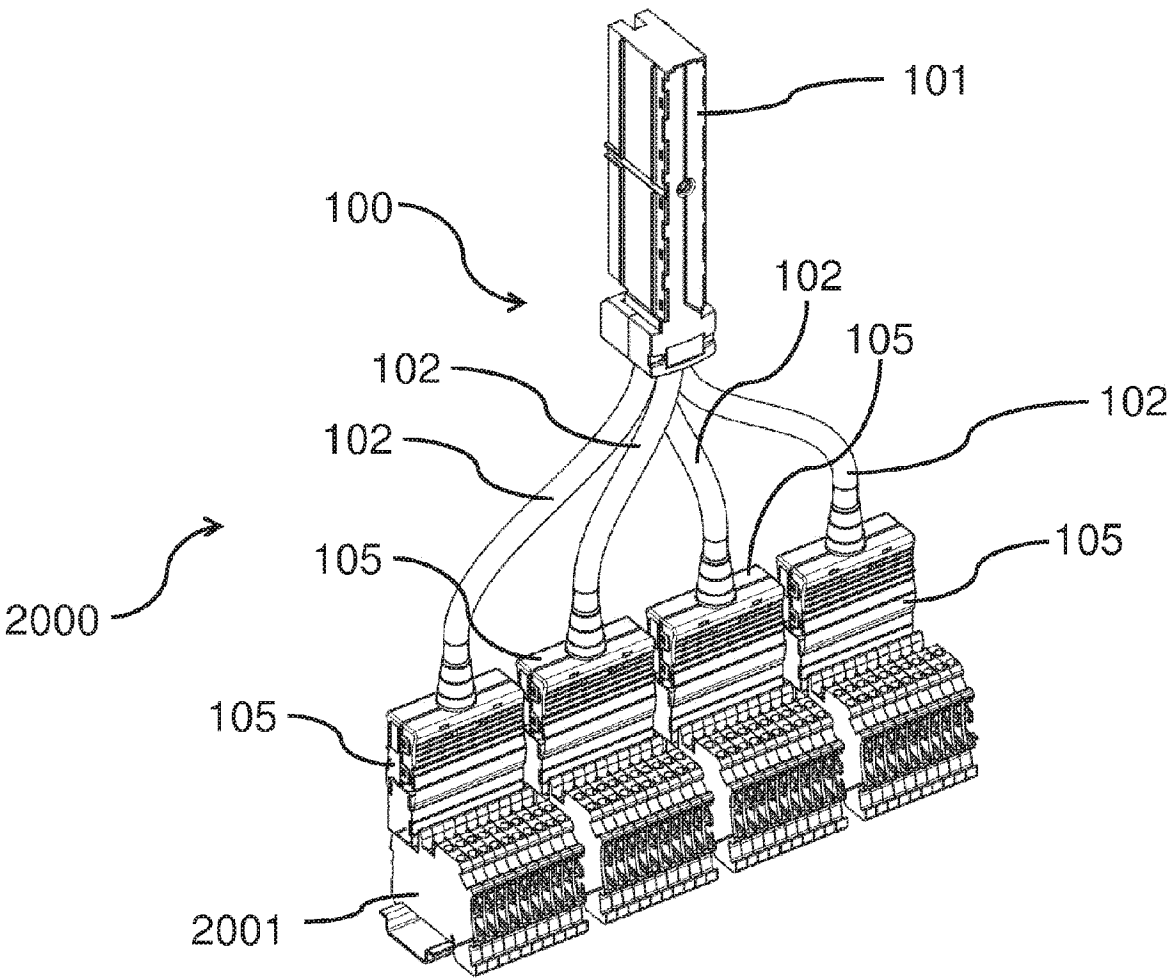
FIG. 19 is a connection arrangement with a connection adapter according to an embodiment and with a series terminal.

FIG. 19 shows a connection arrangement 2000 with a connection adapter 100 according to an embodiment and with a series terminal 1201. The connection adapter 100 comprises a housing 101, connection cables 102 and series terminal connectors 105. The series terminal connectors 105 are connected to the series terminal 2001.

According to an embodiment, the connection adapter 100 can be designed for a direct connection of a programmable logic controller to a relay output board or to a digital input board. Furthermore, analogue input or output devices can be connected by means of the connection adapter 100.

According to an embodiment, the housing 101 is closed and electric-shock-proof for a user or operator.

According to an embodiment, the housing 101 or the adapter can be designed for accommodating electrical connection lines 103 and/or connection cables 102 with different cross-sectional areas or for accommodating different types of line.

According to an embodiment, the electrical connection lines 103 and/or the connection cables 102 can form a line suitable for a corresponding form of signal for a field connection, for example for a connection of a field device. Furthermore, a suitable plug-in connector, which allows a user or operator a direct connection to a series terminal 1901, 2001, can be provided by means of a series terminal connector 105. The series terminal 1901, 2001 can be designed for high electrical outputs.

According to an embodiment, the series terminal connector 105 or a series terminal plug can be connected to the housing 101 by means of ten electrical connection lines 103. Of these, two electrical connection lines 103 can be used for power supply and eight electrical connection lines 103 can be used for conducting signals.

According to an embodiment, the connection adapter 100 or an adapter can comprise a housing cover 703 or a cover and a lower housing part 701 or a lower part with a fastening device which is adapted to the programmable logic controller. Furthermore, the lower housing part 701 or the lower part can comprise a cable duct with a tension relief device 707, which is formed or designed for electrical connection lines 103 or lines with different cross sections.

According to an embodiment, the housing 101 can comprise contact chambers 501 or terminal chambers, into which the electrical connection lines 103, the connection cables 102 and/or the cores can be inserted by means of pre-assembled crimp contacts.

According to an embodiment, in order to increase a dielectric strength, for example for an application with voltages of up to 250V alternating voltage or direct voltage, the contact chambers 501 can be formed or equipped with insulating elements 504 or additional webs, in order to ensure an air gap and creepage path between adjacent contact terminals 503 or the contacts.

According to an embodiment, in order to transmit signals, for example signals of the programmable logic controller, connection cables 102 or cables with ten electrical connection lines 103 with single cores with a cross-sectional area or with a cross section of 0.5 $mm^2$ in the event of full loading can be used. In the process, eight electrical connection lines 103 or eight individual cores of a connection cable 102 can be used for transmitting signals and two electrical connection lines 103 or two cores of a connection cable 102 can be used for the power supply of a field device or of an assembly. Furthermore, the quantity of the electrical connection lines 103 or the quantity of lines can be determined with reference to the quantity of contact pins or with reference to the connection pins of the programmable logic controller. Furthermore, as a result, a control-specific clustering of signals can be facilitated via the series terminal connectors 105 or the terminal plug-in connectors. The signal allocation and the pin assignment can be carried out according to a color coding, according to a numbering or according to a color code, for example according to the DIN 47100 standard.

According to an embodiment, the universal cable duct with a likewise universal tension relief device 707 can also allow the use of electrical connection lines 103 or composite cables and with open ends without connectors.

All the features described and illustrated in connection with individual embodiments of the invention can be provided in different combinations in the subject matter according to the invention, in order to achieve their advantageous effects simultaneously.

The scope of protection of the present invention is specified by the claims and is not restricted by the features described in the description or shown in the drawings.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

100 Connection adapter
101 Housing
102 Connection cable
103 Electrical connection lines
105 Series terminal connector
107 Locking device
109 Labelling element
201 Screw element
300 Circuit diagram
301 Connection
303 Connection
307 Connection
309 Cable tie
400 Circuit diagram
501 Contact chamber
503 Contact terminal
504 Insulating element
505 Housing opening
507 Fastening device
509 Further fastening device
511 Separating device
513 Latch opening
515 Guiding device
517 Locking element
519 Snap-on catch
521 Catch spring
523 Spring-loaded terminal
701 Lower housing part
703 Housing cover
705 Closing element
707 Tension relief device

709 Latching hook
801 Portion
1101 Opening
1201 Coordinate system
1301 Portion
1309 Protruding portion
1311 Protruding portion
1313 Distance
1315 Distance
1317 Distance
1319 Distance
1401 Contact element
1403 Latch spring
1501 Locking washer
1705 Surface
1711 Surface
1713 Surface
1900 Connection arrangement
1901 Series terminal
2000 Connection arrangement
2001 Series terminal

The invention claimed is:

1. A connection adapter for transmitting signals of a programmable logic controller, the programmable logic controller including a signal interface with electrical contact pins arranged in rows, the connection adapter comprising:

contact terminals configured for electrically contacting the electrical contact pins of the signal interface, each contact terminal being configured to receive a respective one of the electrical contact pins;

contact chambers configured to accommodate the contact terminals, each contact terminal being arranged in a respective one of the contact chambers, the contact chambers being arranged in rows, with insulating elements being arranged between adjacent contact chambers;

a housing in which the contact terminals and the contact chambers are received, the housing being closed and electrically insulated via insulating elements;

electrical connection lines electrically connected to the contact terminals, wherein each electrical connection line is electrically connected to one contact terminal, and wherein the housing comprises a housing opening configured to pass the electrical connection lines out of the housing; and a first quantity of series terminal connectors wherein the series terminal connectors are arranged outside of the housing, and wherein each series terminal connector is electrically and mechanically connected to more than one of the electrical connection lines, wherein the insulating elements comprise webs configured to increase an electrical creepage path, and wherein the insulating elements further comprise protruding portions configured to increase the electrical creepage path.

2. The connection adapter according to claim 1, wherein the connection adapter further comprises a flat closing element configured to close the housing opening.

3. The connection adapter according to claim 1, wherein the housing further comprises a fastening device configured to fasten a tension relief device.

4. The connection adapter according to claim 3, wherein the housing further comprises a further fastening device configured to fasten the tension relief device, and wherein the fastening device and the further fastening device are separated by a separating device.

5. The connection adapter according to claim 1, wherein the housing is configured to be locked to the signal interface by a locking element.

6. The connection adapter according to claim 1, wherein the housing is configured to be connected to the signal interface in a force-locked manner by a screw connection.

7. The connection adapter according to claim 1, wherein each contact terminal comprises one spring-loaded terminal configured to receive an electrical contact pin of the signal interface.

8. The connection adapter according to claim 1, wherein each contact terminal further comprises one crimp contact configured for electrical connection to an electrical connection line.

9. The connection adapter according to claim 1, wherein each contact terminal is configured to be snapped into one contact chamber.

10. The connection adapter according to claim 1, wherein the housing comprises a lower housing part, in which the contact terminals and the contact chambers are accommodated, and a housing cover.

11. The connection adapter according to claim 10, wherein the housing cover is configured to be locked to the lower housing part.

12. The connection adapter according to claim 1, wherein the housing further comprises a communication interface for the wireless transmission of the signals of the programmable logic controller, which are fed to the contact terminals.

13. The connection adapter according to claim 12, wherein the communication interface is arranged inside the housing.

14. The connection adapter according to claim 12, wherein the communication interface comprises a transmitting antenna, which is arranged inside the housing or is integrated into a wall of the housing or is arranged on the housing.

* * * * *